United States Patent [19]

Kishimoto et al.

[11] Patent Number: 5,001,041

[45] Date of Patent: Mar. 19, 1991

[54] METHOD FOR PROCESSING SILVER HALIDE COLOR PHOTOGRAPHIC MATERIAL FOR PRINTS

[75] Inventors: Shinzo Kishimoto; Shinji Ueda; Kiyoshi Nakazyo, all of Kanagawa, Japan

[73] Assignee: Fuji Photo Film Co., Ltd., Kanagawa, Japan

[21] Appl. No.: 248,251

[22] Filed: Sep. 19, 1988

Related U.S. Application Data

[63] Continuation of Ser. No. 131,068, Dec. 10, 1987, abandoned, which is a continuation of Ser. No. 7,248, Jan. 27, 1987, abandoned.

[30] Foreign Application Priority Data

| | | | |
|---|---|---|---|
| Jan. 27, 1986 | [JP] | Japan | 61-15544 |
| Feb. 20, 1986 | [JP] | Japan | 61-35749 |
| May 14, 1986 | [JP] | Japan | 61-109899 |

[51] Int. Cl.[5] ..... G03C 7/40; G03C 7/30; G03C 7/32

[52] U.S. Cl. ..... 430/372; 430/376; 430/380; 430/393; 430/432; 430/464; 430/467; 430/558; 430/567

[58] Field of Search ..... 430/372, 380, 376, 393, 430/467, 464, 432, 567, 558

[56] References Cited

U.S. PATENT DOCUMENTS

| | | | |
|---|---|---|---|
| 3,996,054 | 12/1976 | Santemma et al. | 430/377 |
| 4,035,188 | 7/1977 | Yabata et al. | 430/467 |
| 4,299,914 | 11/1981 | Fujumastun et al. | 430/552 |
| 4,304,844 | 12/1981 | Fujumastur et al. | 430/552 |
| 4,336,324 | 6/1982 | Koboshi et al. | 430/372 |
| 4,443,536 | 4/1984 | Lestina | 430/552 |
| 4,461,826 | 7/1984 | Yanashika et al. | 430/505 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,564,590 | 1/1986 | Sasaki et al. | 430/552 |
| 4,564,591 | 1/1986 | Tanaka et al. | 430/567 |
| 4,565,777 | 1/1986 | Ogawa et al. | 430/552 |
| 4,585,733 | 4/1986 | Ezaki et al. | 430/567 |
| 4,590,155 | 5/1986 | Klotzer | 430/567 |
| 4,618,573 | 10/1986 | Okamura et al. | 430/558 |
| 4,640,890 | 2/1987 | Fujita et al. | 430/504 |

FOREIGN PATENT DOCUMENTS

| | | |
|---|---|---|
| 0082649 | 6/1983 | European Pat. Off. . |
| 0086074 | 8/1983 | European Pat. Off. . |
| 0119860 | 9/1984 | European Pat. Off. . |
| 0151305 | 8/1985 | European Pat. Off. . |
| 211437 | 2/1987 | European Pat. Off. . |
| 29461 | 8/1974 | Japan . |
| 52058 | 4/1980 | Japan . |
| 200037 | 12/1982 | Japan . |
| 31334 | 2/1983 | Japan . |
| 42045 | 3/1983 | Japan . |
| 50536 | 3/1983 | Japan . |
| 48755 | 3/1984 | Japan . |
| 174836 | 10/1984 | Japan . |
| 177553 | 10/1984 | Japan . |
| 177555 | 10/1984 | Japan . |
| 177556 | 10/1984 | Japan . |
| 177557 | 10/1984 | Japan . |
| 178459 | 10/1984 | Japan . |
| 19140 | 1/1985 | Japan . |
| 26338 | 2/1985 | Japan . |
| 26339 | 2/1985 | Japan . |
| 158444 | 8/1985 | Japan . |
| 162256 | 8/1985 | Japan . |
| 158446 | 9/1985 | Japan . |
| 172042 | 9/1985 | Japan . |
| 177554 | 10/1985 | Japan . |
| 70552 | 4/1986 | Japan . |
| 830250 | 2/1987 | Japan . |

OTHER PUBLICATIONS

Research Disclosure, No. 257, Sep. 1985, pp. 481–499, No. 25758 European Search Report.

*Primary Examiner*—Charles L. Bowers, Jr.
*Assistant Examiner*—Patrick A. Doody
*Attorney, Agent, or Firm*—Sughrue, Mion, Zinn, Macpeak & Seas

[57] ABSTRACT

A method for processing a silver halide color photographic material for prints comprising a color developing step, a bleach-fixing step, and either a stabilizing step or a water washing step is described, wherein the silver halide color photographic material comprises a reflective support having thereon at least one silver halide emulsion layer containing a silver halide having a silver chloride content of not less than 90 mol % and substantially not containing silver iodide, and the color developing step is conducted using a processing solution that does not substantially contain benzyl alcohol.

According to the method of the present invention, the amount of water required in a water washing step or a stabilizing step can be greatly reduced without decreasing liquid stability of the water for washing or the stabilizing solution, and color prints having improved preservability are obtained.

The method is particularly useful when the silver halide color photographic material contains a pyrazoloazole type magenta coupler.

32 Claims, No Drawings

METHOD FOR PROCESSING SILVER HALIDE COLOR PHOTOGRAPHIC MATERIAL FOR PRINTS

This is a continuation of application Ser. No. 07/131,068 filed Dec. 10, 1987 now abandoned, which is a continuation of application Ser. No. 07/007,248 filed Jan. 27, 1987 now abandoned.

FIELD OF THE INVENTION

The present invention relates to a method for processing a silver halide color photographic material for prints and, more particularly, to a method for processing a silver halide color photographic material which can reduce amount of water required in a water washing step, a stabilizing step, etc.

BACKGROUND OF THE INVENTION

Conventional processing steps of silver halide color photographic materials for prints include a water washing step, etc. Over the years, some techniques have been suggested for the purpose of reducing the amount of water used, such as the amount of washing water, etc., in view of environmental conservation, water resources, or cost. For example, in S. R. Goldwasser, "Water Flow Rates in Immersion-Washing of Motion Picture Film" in *Journal of the Society of Motion Picture and Television Engineers*, Vol. 64, pages 248 to 253 (May, 1955), a method for reducing the amount of washing water by means of utilizing multistage water washing tanks and countercurrent water is described.

Also, for the purpose of omitting the water washing step or extremely reducing the amount of washing water, a technique using a multistage countercurrent stabilizing process, as described, e.g., in Japanese Patent Application (OPI) No. 8543/82 (the term "OPI" as used herein refers to a "published unexamined Japanese patent application"), is known.

These methods are effective in saving water, and have been applied to various types of automatic developing machines. However, it has been found that washing water into which ions from a bleaching step and thiosulfates from a fixing step are introduced during processing is very unstable, and the reduction in a wide range of the amount of washing water leads to prolonged remaining time of washing water and results in causing a problem in that various precipitates, floating scum, and coloration are generated.

These precipitates and floating scum create many problems. For example, they adhere on photographic light-sensitive materials and choke up or stain filters in an automatic developing (processing) machine.

In order to solve these troubles, various methods for preventing precipitation in washing water are proposed. For instance, in L. E. West, *Phot. Sci. and Eng.*, Vol. 9, pages 344 to 359 (1965), there are described the addition of chelating agents and sterilizers to washing water.

Further, the addition of various antimold agents are described in Japanese Patent Application (OPI) Nos. 8542/82, 105145/83, 157244/82 and 4050/86, etc. However, these compounds have some problems in that they have poor solubility, that they are troublesome in view of their relative lack of safety, that they have only insufficient effects on preventing generation of floating scum, precipitates, and coloration, or that they harm stability of images formed and, therefore, satisfactory results cannot be obtained.

Moreover, as a result of our investigations it has found that when color photographic light-sensitive materials for prints are subjected to processing with saving water, color fading of magenta dyes formed in prints is accelerated during preservation of the prints at high temperature and high humidity.

SUMMARY OF THE INVENTION

Therefore, an object of the present invention is to provide a method for processing a silver halide color photographic material for a print, in which liquid stability of water for washing or a stabilizing solution is improved when an amount of water required in the water washing step or the stabilizing step is reduced in a wide range.

Another object of the present invention is to provide a method for processing a silver halide color photographic material for a print by which stability of the print thus-processed is improved during preservation for a long period of time.

Other objects of the present invention will become apparent from the following detailed description and examples.

It has now been discovered that the above-described objects of the present invention can be effectively attained by a method for processing a silver halide color photographic material for a print comprising a color developing step, a bleach-fixing step, and either a stabilizing step or a water washing step, wherein the silver halide color photographic material comprises a reflective support having thereon at least one silver halide emulsion layer containing a silver halide having a silver chloride content of not less than 90 mol %, and the color developing step is conducted using a processing solution that does not substantially contain benzyl alcohol.

DETAILED DESCRIPTION OF THE INVENTION

The color developing solution which can be used in the present invention is characterized by substantially not containing benzyl alcohol. The terminology "not substantially containing benzyl alcohol" or the like used in the present invention means that the color developing solution contains benzyl alcohol in a concentration of less than 0.5 ml per liter of the color developing solution. It is preferred that the color developing solution does not contain benzyl alcohol at all.

It has also been found that the above-described color fading of magenta dyes formed during preservation for a long period of time is further prevented when the silver halide color photographic material for a print according to the present invention contains a pyrazoloazole type magenta coupler represented by formula (I):

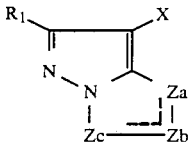

(I)

wherein $R_1$ represents a hydrogen atom or a substituent, preferably that having the same meanings as defined in $R_2$ of formulae (II) to (VII) as stated below; X represents a hydrogen atom or a group capable of being released upon a coupling reaction with an oxidation product of an aromatic primary amine developing agent; Za, Zb and Zc each represents a methine group, a substituted methine group, =N— or —NH—, with one of the Za-Zb bond and the Zb-Zc bond being a double bond and the other being a single bond; when the Zb-Zc bond is a carbon-carbon double bond, the Zb-Zc bond may be a part of a condensed aromatic ring; or $R_1$ or X forms a dimer or higher polymer; or Za, Zb or Zc is a substituted methine group forming a dimer or higher polymer.

As a magenta coupler, 3-anilino-5-pyrazolone type magenta couplers can also be used with a silver halide emulsion preferably having not less than 97 mol % of silver chloride content. These couplers are disclosed in, for example, U.S. Pat. Nos. 2,311,082, 2,343,703, 2,600,788, 2,908,573, 3,062,653, 3,152,896, 3,936,015, 4,310,619 and 4,351,897, and European Patent No. 73,636.

Moreover, it has been found that coloration of washing water or a stabilizing solution is further prevented by incorporating at least one organic phosphonic acid type chelating agent into the color developing solution substantially not containing benzyl alcohol according to the present invention.

The method of processing according to the present invention is particularly suitable for a continuous processing.

As described above, when an amount of water required for washing with water or a stabilizing solution is reduced in a wide range, components of a bleach-fixing solution, a large amount of water-soluble silver complex salts and decomposition products thereof are introduced into the washing water or stabilizing solution and liquid stability of the washing water or stabilizing solution is degraded and results in causing problems of floating scum, precipitates, and coloration, etc.

Further, the new problem becomes apparent in that color fading of magenta dyes formed is accelerated during preservation of the color photographic material after processing at high temperature and high humidity in case of processing with saving water.

In order to improve the above-described liquid stability, methods of adding metal salts or antimold agents, etc., have been heretofore known as described in Japanese Patent Application (OPI) Nos. 97530/82, 105145/83, 134636/83, 184344/84, 185336/84, 134237/85, 239751/85 and 4050/86, etc.

However, of the antimold agents, those having a strong sterilizing power create some concerns regarding safety of the human body. On the other hand, metal salts have problems in view of environmental pollution. Therefore, it has been desired to develop a more preferred technique for improvement in liquid stability of water for washing or a stabilizing solution.

As a result of extensive investigations, it has been surprisingly found that when silver halide color photographic materials for prints are continuously processed using a color developing solution which does not contain benzyl alcohol (which is indispensable in conventional color developing solutions employed to process silver halide color photographic materials for prints), not only liquid stability of water for washing or a stabilizing solution is greatly improved, but also the color fading of magenta dyes formed is prevented during preservation of the color photographic materials after processing at high temperature and high humidity. Particularly, when the color developing solution contains an organic phosphonic acid chelating agent, the liquid stability is further improved, and when in the silver halide color photographic materials for prints, a pyrazoloazole type magenta coupler is employed, the color fading of magenta dyes formed is further prevented during preservation of the color photographic materials after processing at high temperature and high humidity.

The pyrazoloazole type magenta couplers which can be used in the present invention are the compounds represented by formula (I) described above.

The term "polymer" as used with respect to the compound represented by formula (I) means a compound containing at least two groups derived from the compound represented by formula (I) in its molecule, and includes a bis coupler and a polymeric coupler. The polymeric coupler may be either a homopolymer composed of only a monomer having a moiety represented by formula (I) (preferably a monomer having a vinyl group, hereinafter referred to as a vinyl monomer) or a copolymer composed of a vinyl monomer described above and a non-color forming ethylenic monomer which does not undergo coupling with the oxidation product of an aromatic primary amine developing agent.

The compounds represented by formula (I) are nitrogen-containing heterocyclic 5-membered ring-condensed 5-membered ring type couplers. Their color forming nuclei show aromaticity isoelectronic to naphthalene and have chemical structures inclusively called azapentalene. Preferred compounds among the couplers represented by formula (I) are 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles represented by formulae (II), (III), (IV), (V), (VI) and (VII) shown below, respectively. Of these, the compounds represented by formulae (II), (IV) and (V) are preferred, and the compounds represented by formulae (II) and (V) are particularly preferred.

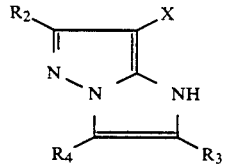

(II)

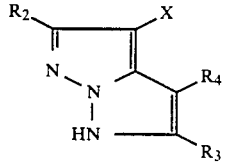

(III)

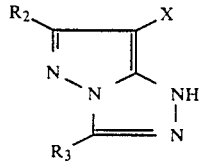

(IV)

-continued

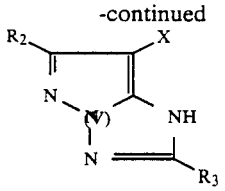

(V)

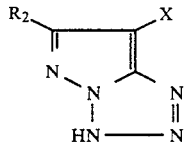

(VI)

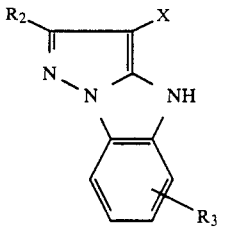

(VII)

In formula (II), (III), (IV), (V), (VI) or (VII), $R_2$, $R_3$ and $R_4$ (which may be the same or different) each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X represents a hydrogen atom, a halogen atom, a carboxy group, or a group capable of being released upon coupling which is bonded to the carbon atom at the coupling position through an oxygen atom, a nitrogen atom, or a sulfur atom.

Also, $R_2$, $R_3$, $R_4$ or X may be a divalent group forming a bis coupler. Further, the coupler represented by formula (II), (III), (IV), (V), (VI) or (VII) may be in the form of a polymeric coupler in which formula (I) constitutes a partial structure of a vinyl monomer and $R_2$, $R_3$ or $R_4$ represents a chemical bond or a linking group, through which the partial structure of formula (II), (III), (IV), (V), (VI) or (VII) and the vinyl group are connected to each other.

In more detail, $R_2$, $R_3$ and $R_4$ each represents a hydrogen atom, a halogen atom (e.g., a chlorine atom, a bromine atom, etc.), an alkyl group (e.g., a methyl group, a propyl group, a tert-butyl group, a trifluoromethyl group, a tridecyl group, a 3-(2,4-di-tert-amylphenoxy)-propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-tert-butylphenyl group, a 2,4-di-tert-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-tert-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-tert-amylphenoxy)-butyramido group, a γ-(3-tert-butyl-4-hydroxyphenoxy)butyramido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-tert-butyl-4-hydroxyphenoxy)dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), an arylthio group (e.g., a phenylthio group, a 2-butoxy-5-tert-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethysulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.), or an aryloxycarbonyl group (e.g., a phenyloxycarbonyl group, a 3-pentadecylphenyloxycarbonyl group, etc.); and X represents a hydrogen atom; a halogen atom (e.g., a chlorine atom, a bromine atom, an iodine atom, etc.); a carboxy group; a group bonded to the coupling position through an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.); a group bonded to the coupling position through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-5-ethoxy-3-hydantoinyl group, a 2N-1,1-dioxo-3-(2H)-oxo-1,2-benzisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.); or a group bonded to the coupling position through a sulfur atom (e.g., a phenylthio group, a 2-carboxyphenylthio group, a 2-methoxy-5-tert-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolythio group, a 2-benzothiazolylthio group, a 2-dodecylthio-5-thiophenylthio group, a 2-phenyl-3-dodecyl-1,2,4-triazolyl-5-thio group, etc.).

When $R_2$, $R_3$, $R_4$ or X represents a divalent group forming a bis coupler, such a divalent group includes a substituted or unsubstituted alkylene group (e.g., a methylene group, an ethylene group, a 1,10-decylene group, —$CH_2CH_2$—O—$CH_2CH_2$—, etc.), a substituted or unsubstituted phenylene group (e.g., a 1,4-phenylene group, a 1,3-phenylene group,

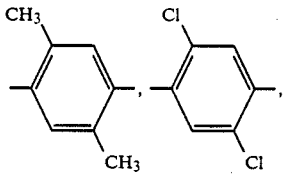

etc.), and an —NHCO—R—CONH— group wherein R represents a substituted or unsubstituted alkylene or phenylene group.

The linking group represented by $R_2$, $R_3$ or $R_4$ in the cases wherein the coupler moiety-represented by formula (II), (III), (IV), (V), (VI) or (VII) is included in a vinyl monomer includes an alkylene group (including a substituted or unsubstituted alkylene group, e.g., a methylene group, an ethylene group, a 1,10-decylene group, —$CH_2CH_2$—O—$CH_2CH_2$—, etc.), a phenylene group (including a substituted or unsubstituted phenylene group, e.g., a 1,4-phenylene group, a 1,3-phenylene group,

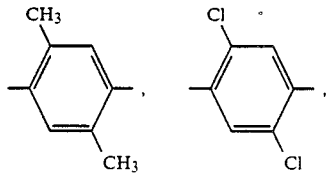

etc.), —NHCO—, —CONH—, —O—, —OCO—, and an aralkylene group, e.g.,

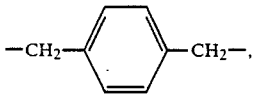

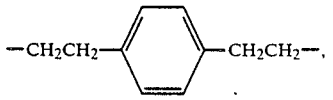

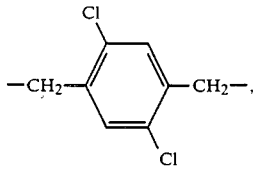

etc.) or a combination thereof.

Further, a vinyl group in the vinyl monomer may further have a substituent in addition to the coupler moiety represented by formula (II), (III), (IV), (V), (VI) or (VII). Preferred examples of the substituents include a hydrogen atom, a chlorine atom, or a lower alkyl group having from 1 to 4 carbon atoms.

Examples of non-color forming ethylenic monomers which do not undergo coupling with the oxidation product of an aromatic primary amine developing agent include an acrylic acid (such as acrylic acid, chloroacrylic acid, an α-alkylacrylic acid (e.g., methacrylic acid, etc.)), an ester or an amide derived from an acrylic acid (e.g., acrylamide, n-butylacrylamide, tert-butylacrylamide, diacetonacrylamide, methacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), methylenedibisacrylamide, a vinyl ester (e.g., vinyl acetate, vinyl propionate, vinyl laurate, etc.), acrylonitrile, methacrylonitrile, an aromatic vinyl compound (e.g., styrene and a derivative thereof, vinyltoluene, divinylbenzene, vinylacetophenone, sulfostyrene, etc.), itaconic acid, citraconic acid, crotonic acid, vinylidene chloride, a vinyl alkyl ether (e.g., vinyl ethyl ether, etc.), maleic acid, maleic anhydride, a maleic acid ester, N-vinyl-2-pyrrolidone, N-vinylpyridine, 2- or 4-vinylpyridine, etc.

Two or more non-color forming ethylenically unsaturated monomers can be used together.

Of the couplers of formulae (II) to (VII), the coupler of formula (V) is the most preferred. In these formulae (II), (IV) and (V), at least one of $R_2$ and $R_3$ is preferably a branched, substituted or unsubstituted alkyl group, that is, an alkyl group or a substituted alkyl group which is connected to a pyrazoloazole skeleton through a secondary or tertiary carbon atom, wherein a secondary carbon atom means a carbon atom to which only one hydrogen atom is directly connected, and a tertiary carbon atom means a carbon atom to which no hydrogen atom but preferably an alkyl group or a substituted alkyl group is directly connected. The examples of the substituted alkyl group are a sulfonamidoalkyl group, a sulfonamidoarylalkyl group, a sulfonylalkyl group and the like, wherein a sulfonamidoarylsulfonamidoalkyl group is preferred as a sulfonamidoalkyl group.

Specific examples of the pyrazoloazole type magenta couplers represented by formulae (II), (III), (IV), (V), (VI) and (VII) which can be used in the present invention, and methods for synthesis thereof, are described in the following literature.

Compounds of formula (II) are described in Japanese Patent Application (OPI) No. 162548/84, etc.; compounds of formula (III) are described in Japanese Patent Application (OPI) No. 43659/85, etc.; compounds of formula (IV) are described in Japanese Patent Publication No. 27411/72, etc.; compounds of formula (V) are described in Japanese Patent Application (OPI) Nos. 171956/84 and 172982/85, etc.; compounds of formula (VI) are described in Japanese Patent Application (OPI) No. 33552/85, etc.; and compounds of formula (VII) are described in U.S. Pat. No. 3,061,432, etc., respectively.

In addition, highly color-forming ballast groups as described, for example, in Japanese Patent Application (OPI) Nos. 42045/83, 214854/84, 177553/84, 177554/84 and 177557/84, etc., can be applied to any of the compounds represented by formula (II), (III), (IV), (V), (VI) or (VII) described above.

Specific examples of the pyrazoloazole type couplers which can be employed in the present invention are set forth below, but the present invention is not to be construed as being limited thereto, (M-1)

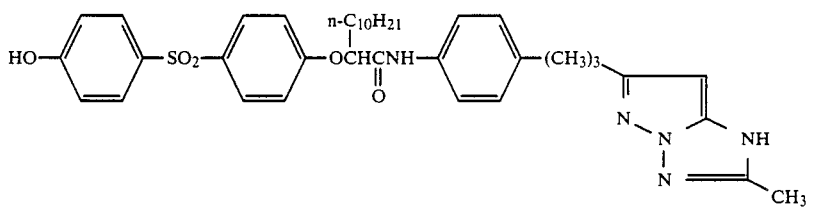

(M-2)

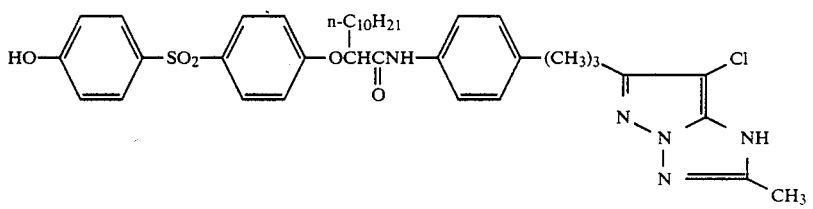

(M-3)

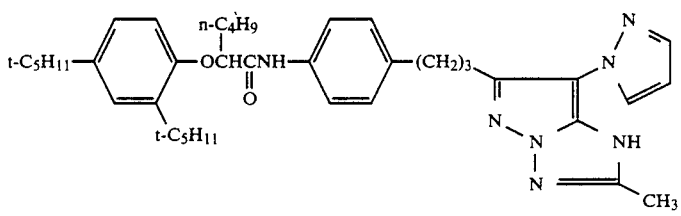

(M-4)

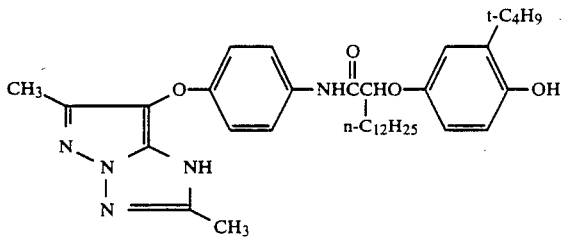

(M-5)

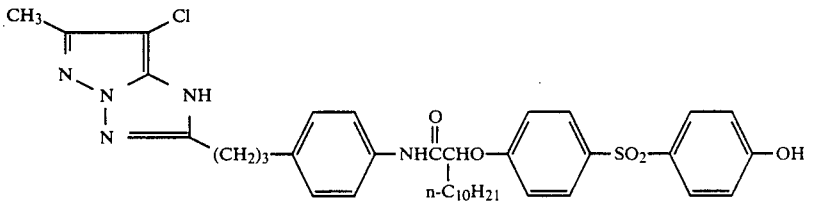

-continued
(M-6)
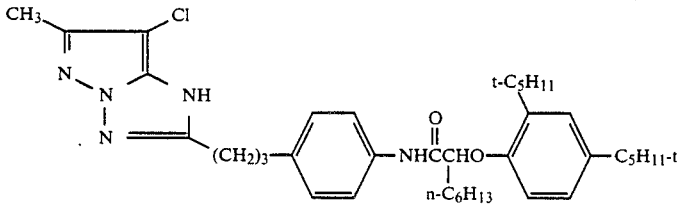
(M-7)
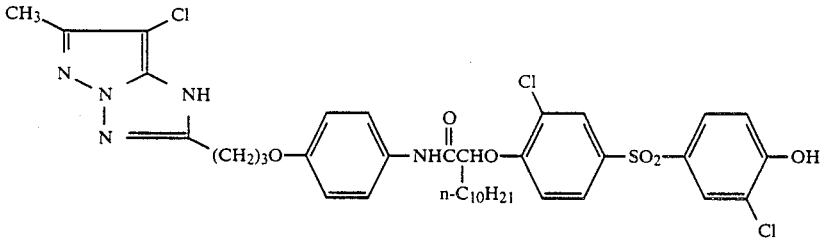
(M-8)
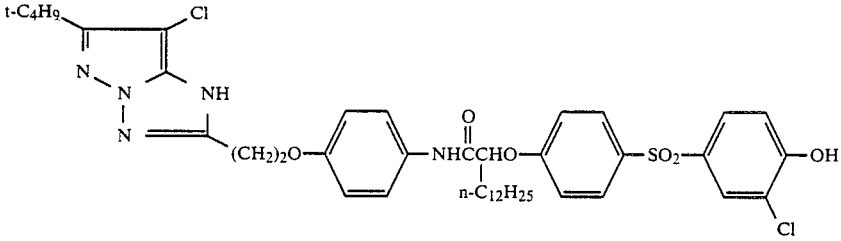
(M-9)
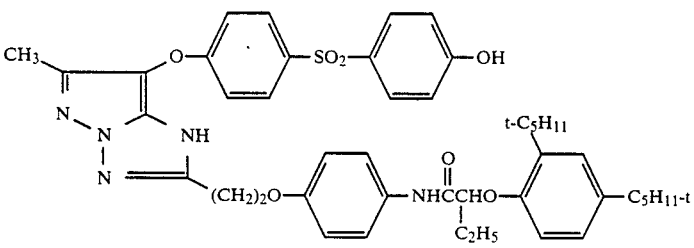
(M-10)
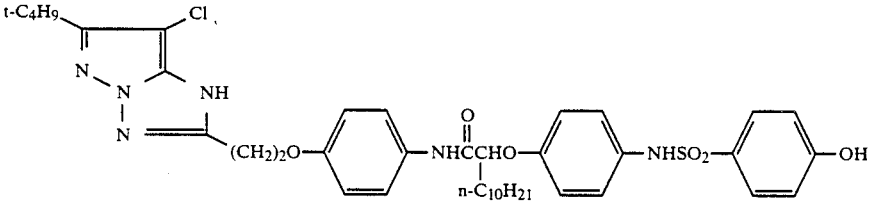
(M-11)
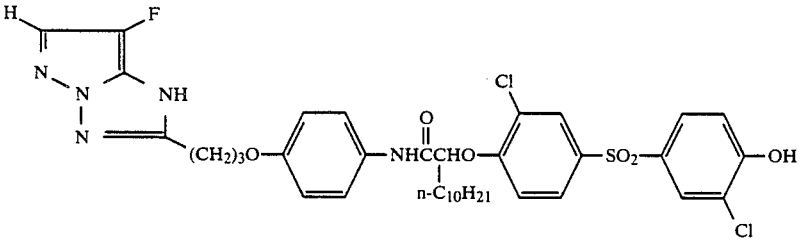
(M-12)
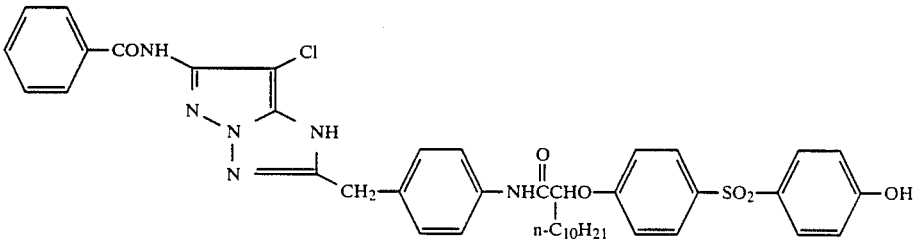

-continued
(M-13)
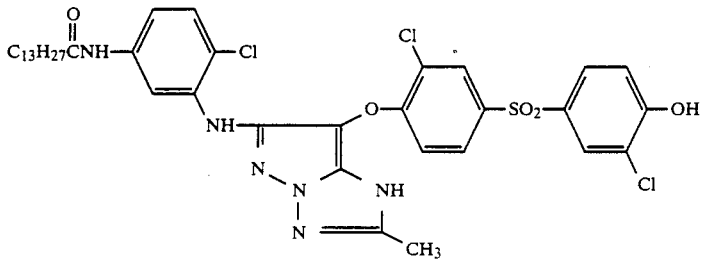
(M-14)
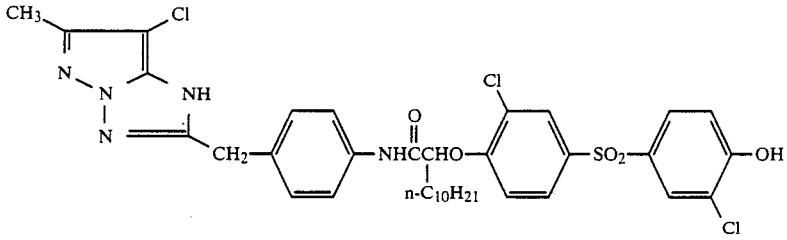
(M-15)
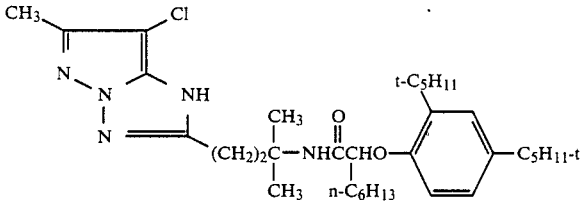
(M-16)
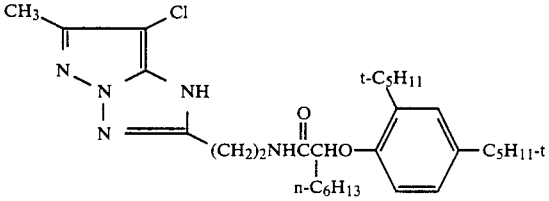
(M-17)
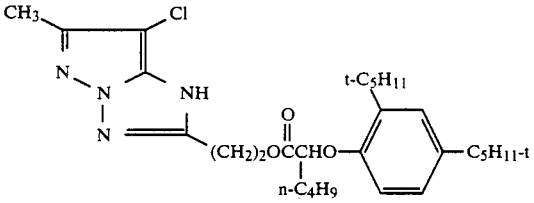
(M-18)
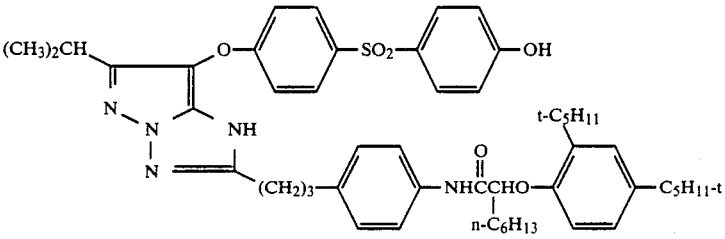
(M-19)
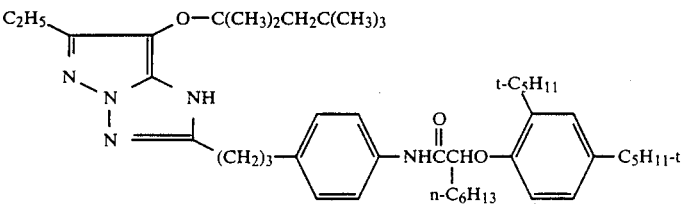

-continued
(M-20)
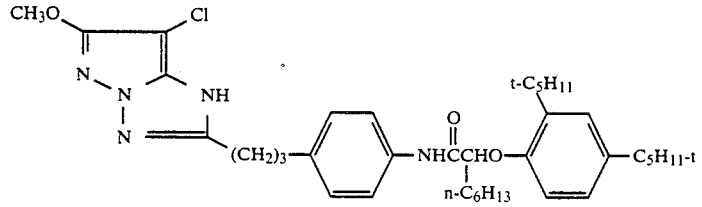
(M-21)
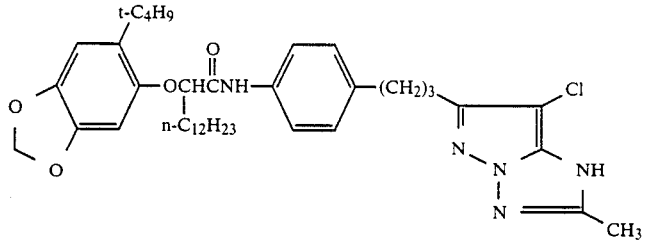
(M-22)
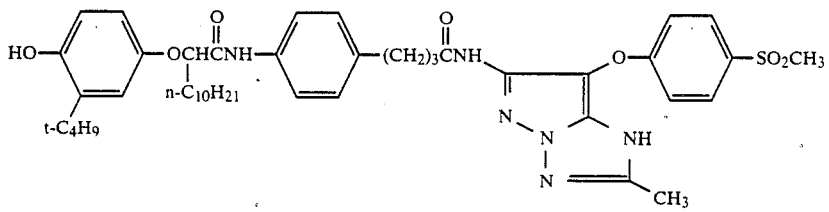
(M-23)
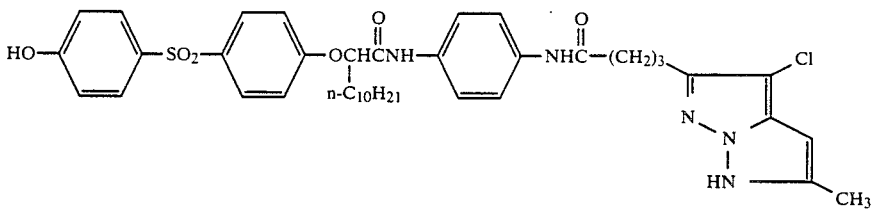
(M-24)
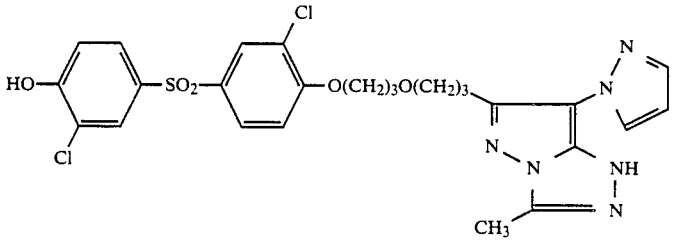
(M-25)
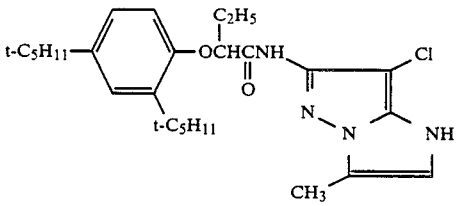
(M-26)
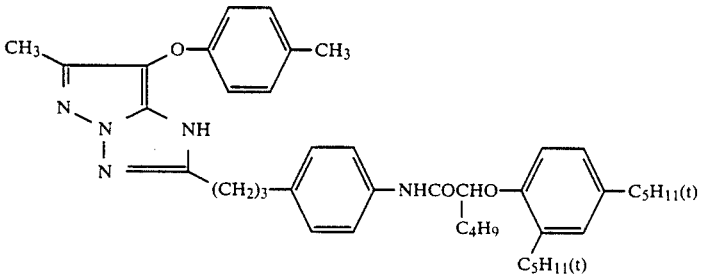

-continued
(M-27)
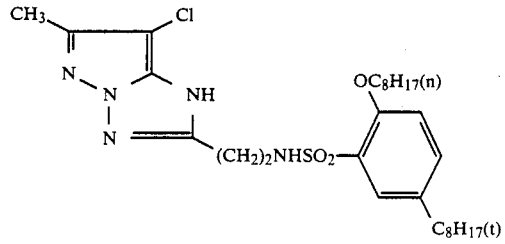
(M-28)
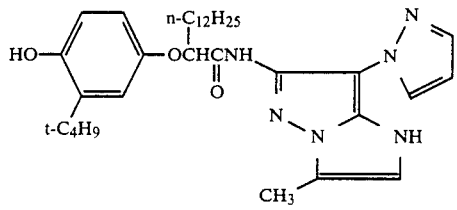
(M-29)
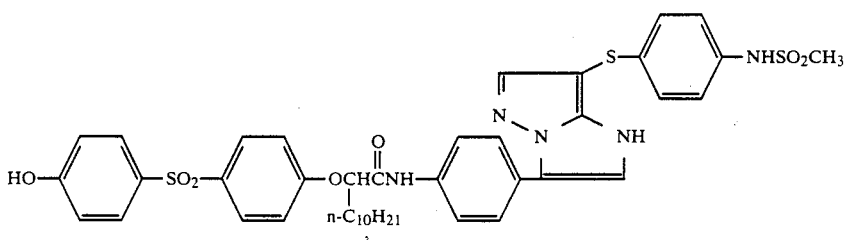
(M-30)
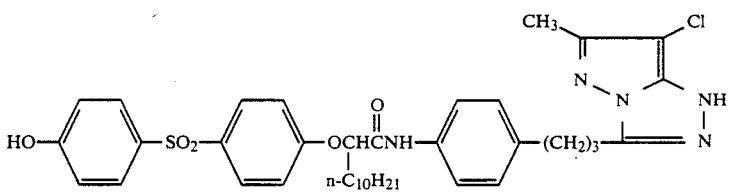
(M-31)
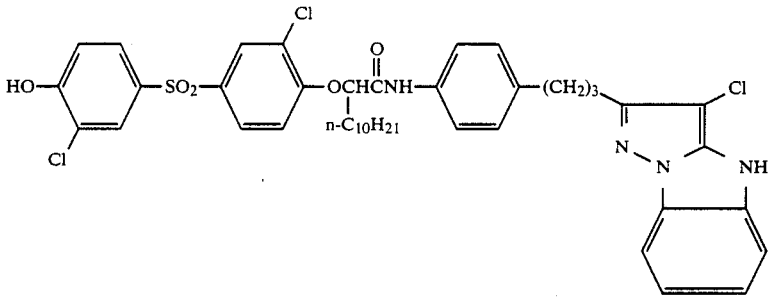
(M-32)
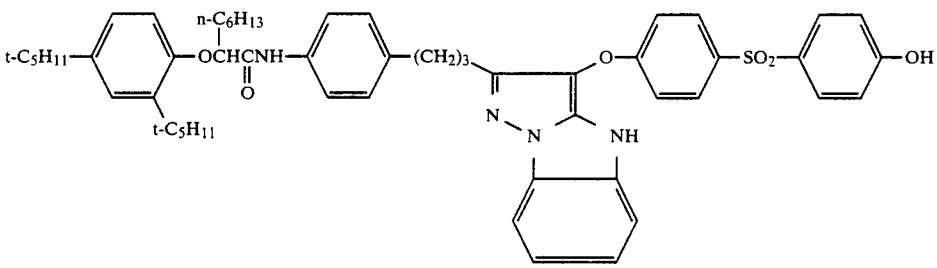

-continued
(M-33)
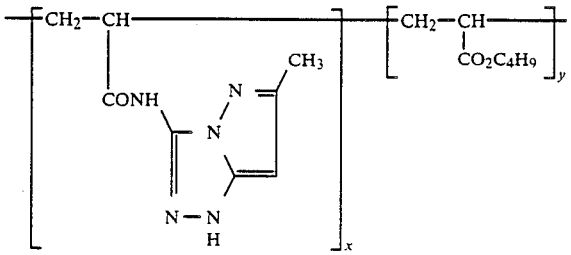
x/y = 50/50 (weight ratio)
(M-34)
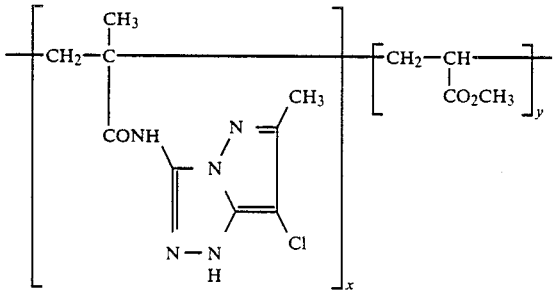
x/y = 40/60
(M-35)
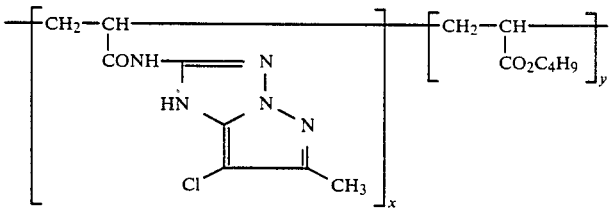
x/y = 50/50
(M-36)
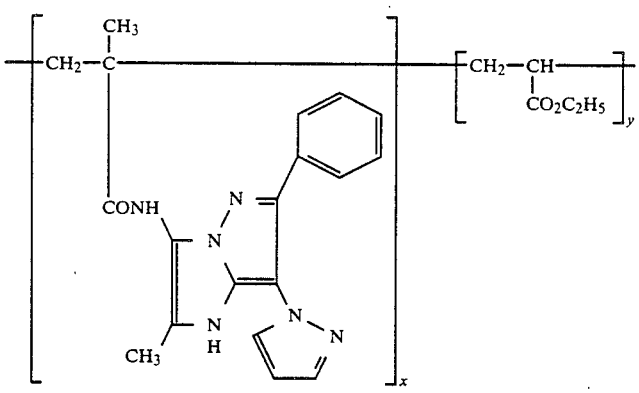
x/y = 33/43
(M-37)
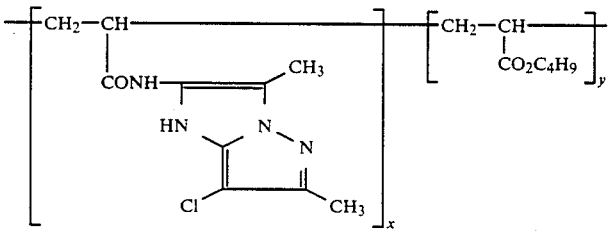
x/y = 50/50

-continued
(M-38)
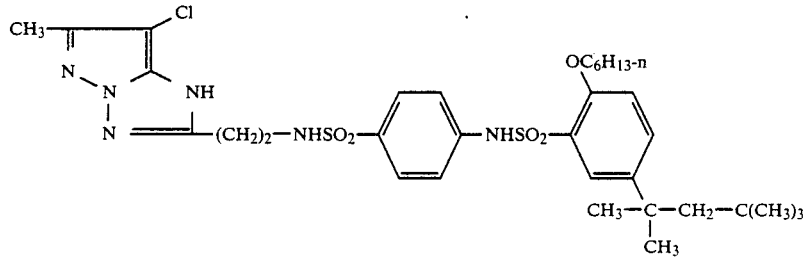
(M-39)
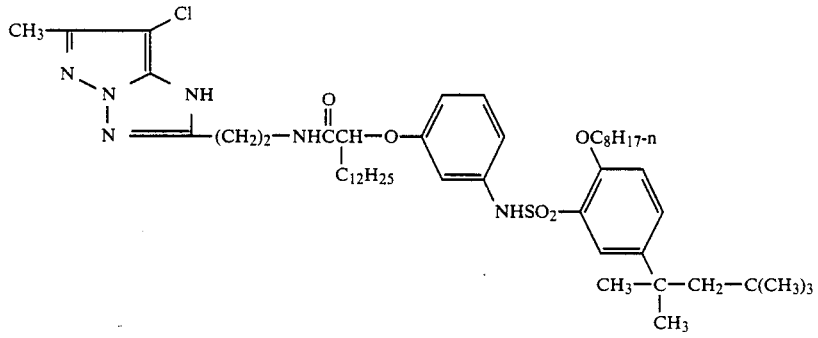
(M-40)
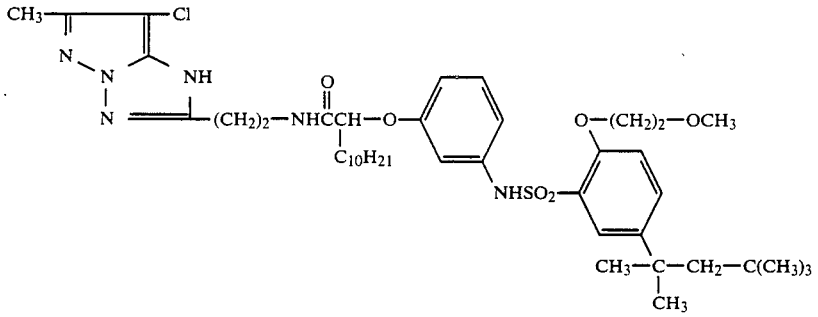
(M-41)
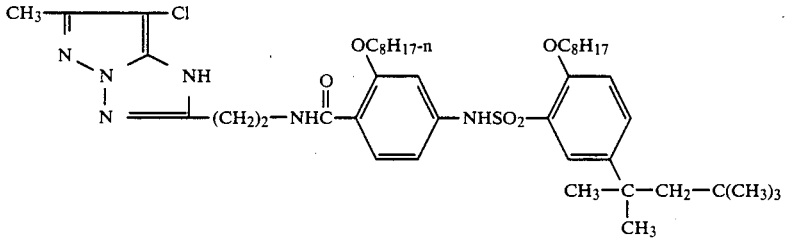
(M-42)
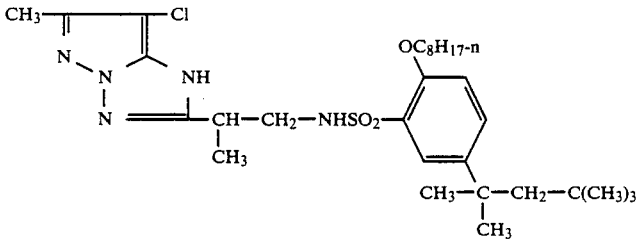
(M-43)
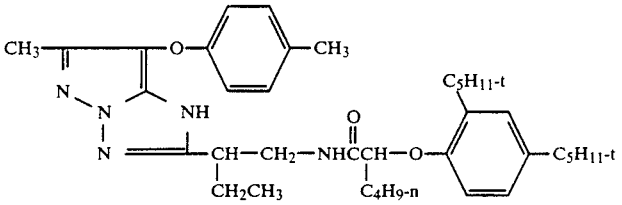

-continued
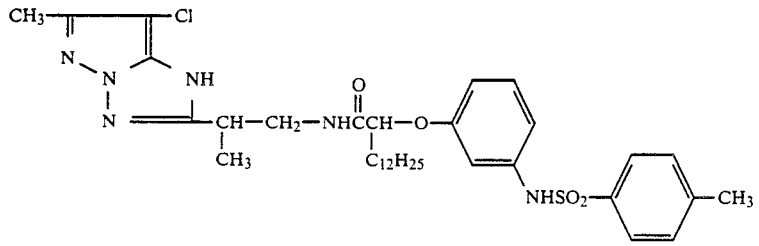
(M-44)
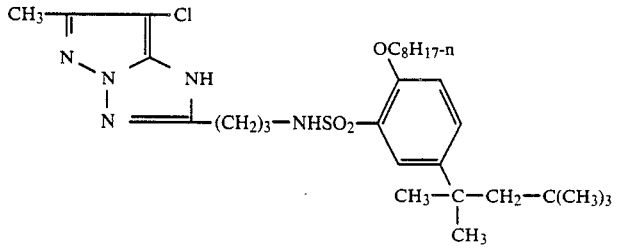
(M-45)
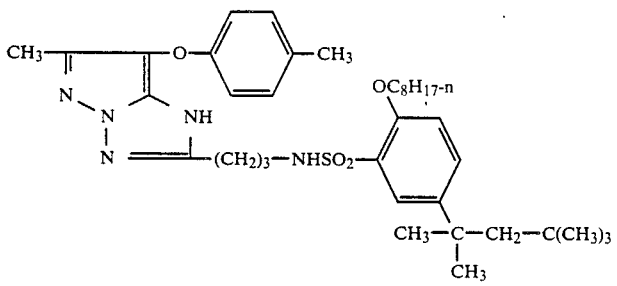
(M-46)
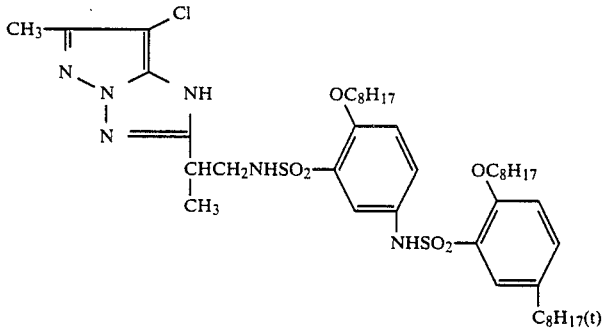
(M-47)
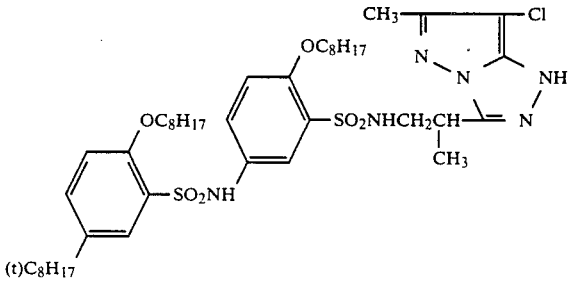
(M-48)

-continued
(M-49)
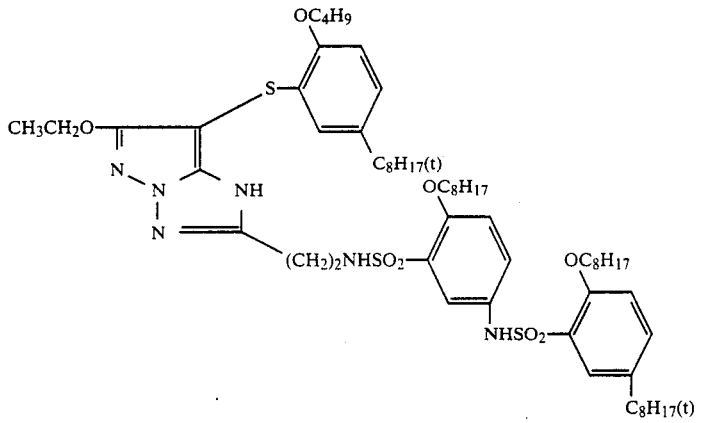
(M-50)
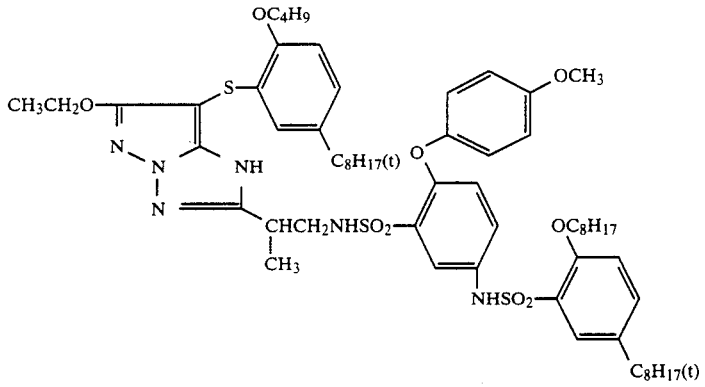
(M-51)
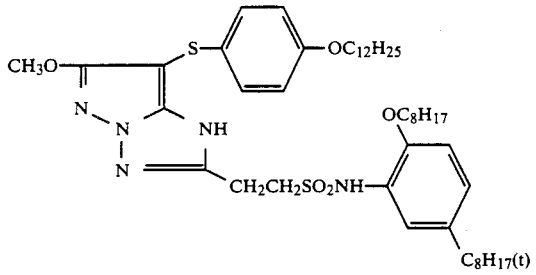
(M-52)
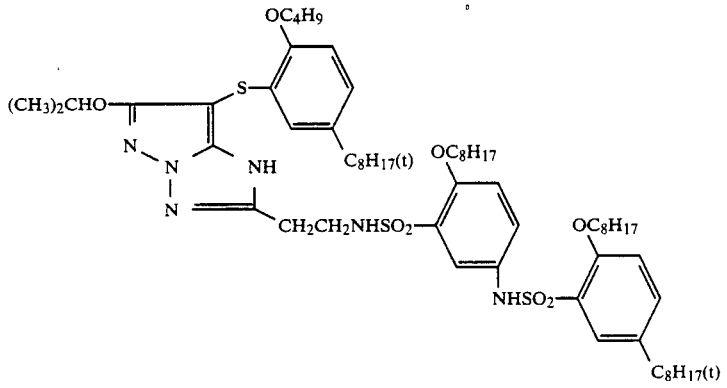

-continued
(M-53)
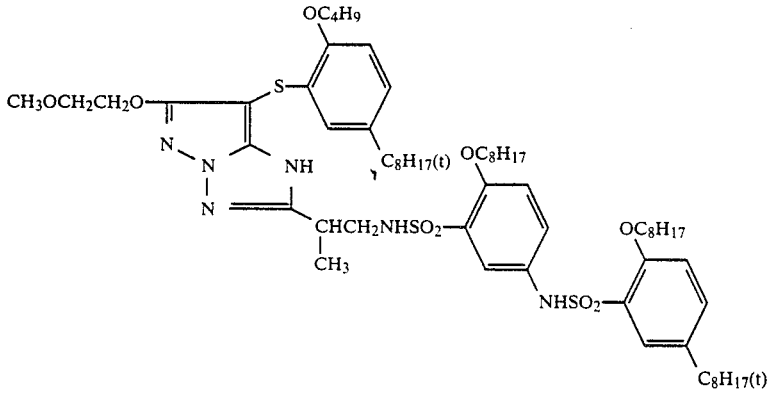
(M-54)
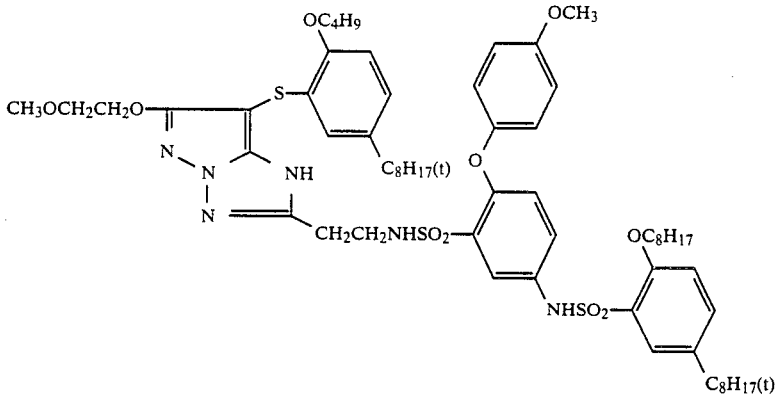
(M-55)
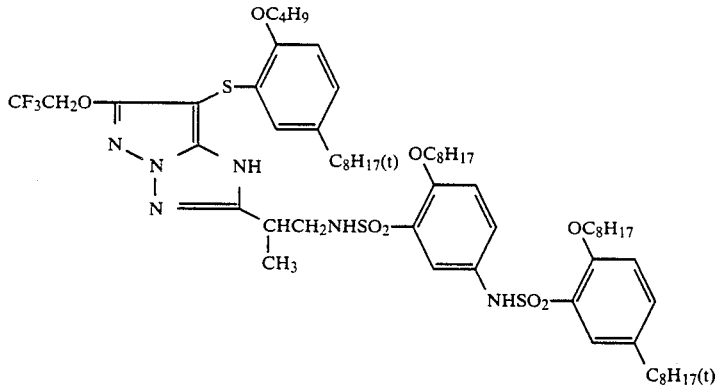
(M-56)
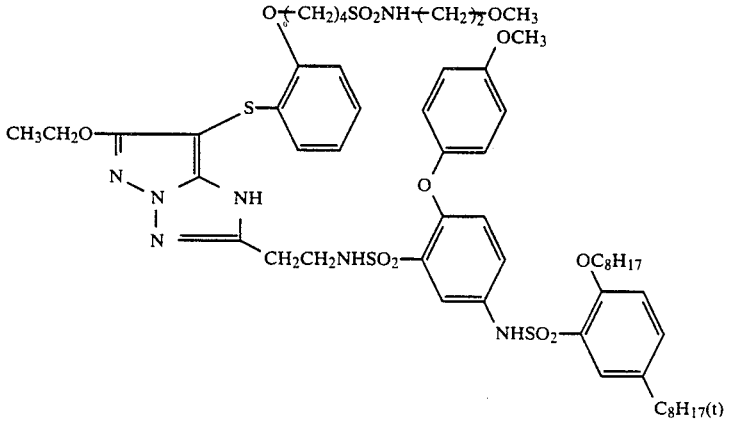

-continued
(M-57)
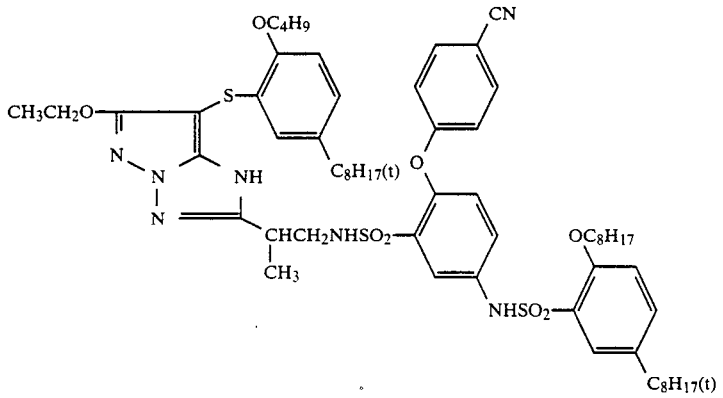
(M-58)
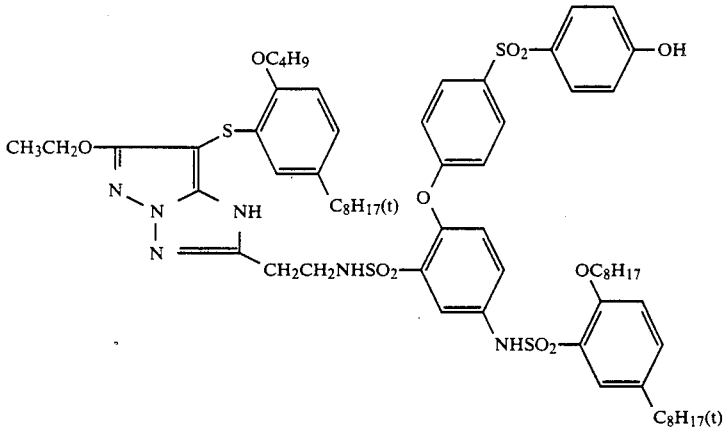
(M-59)
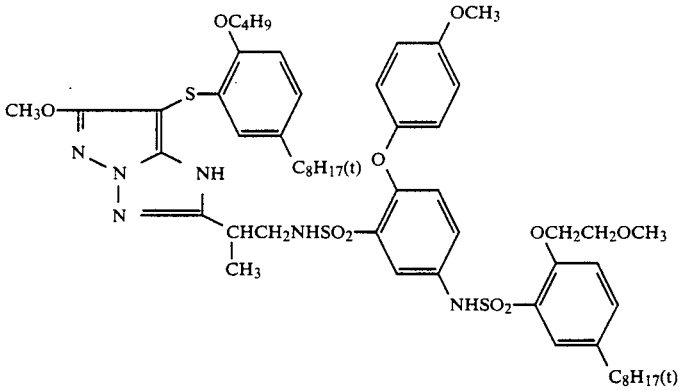
(M-60)
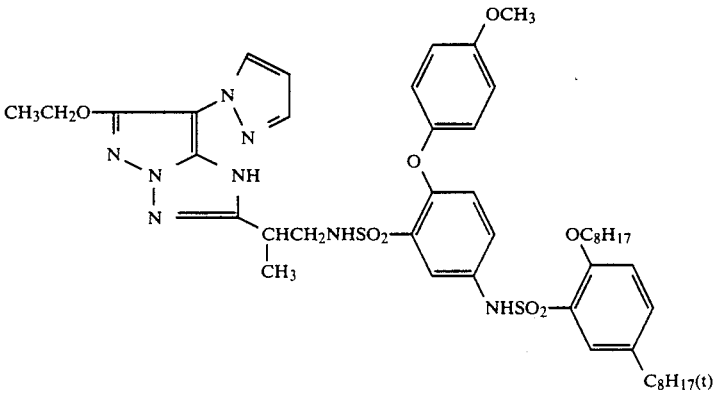

-continued
(M-61)
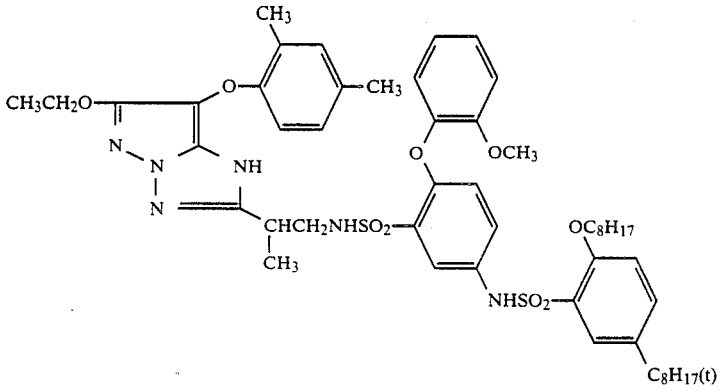
(M-62)
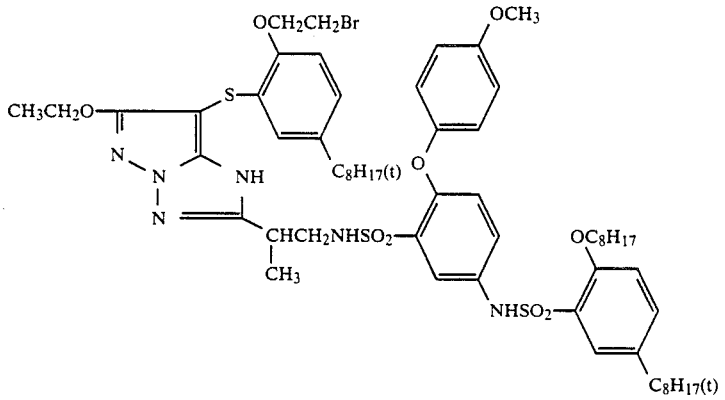
(M-63)
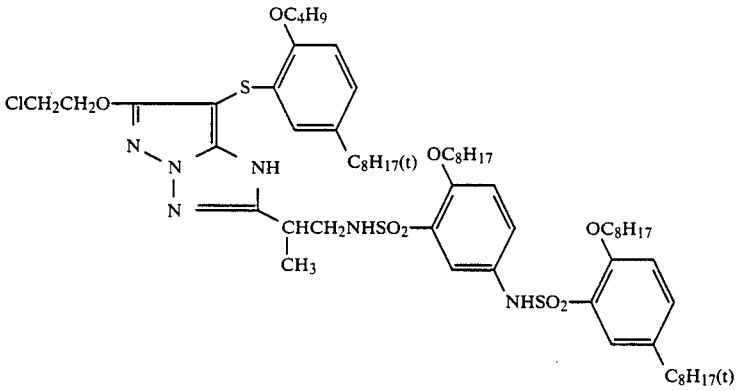
(M-64)
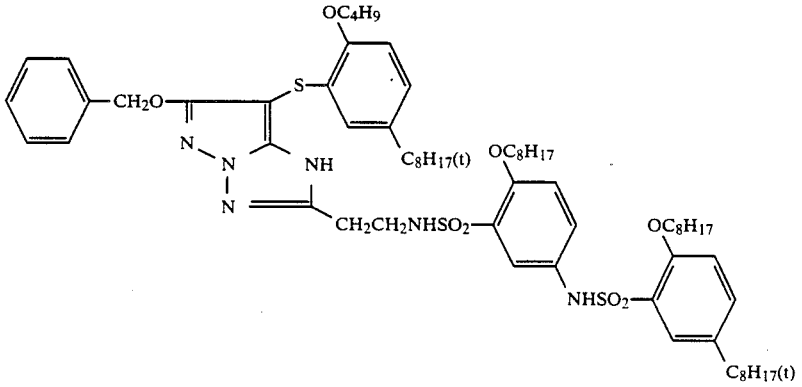

-continued
(M-65)
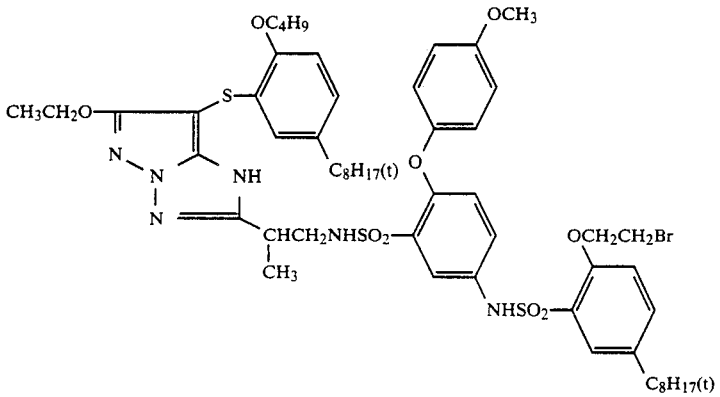
(M-66)
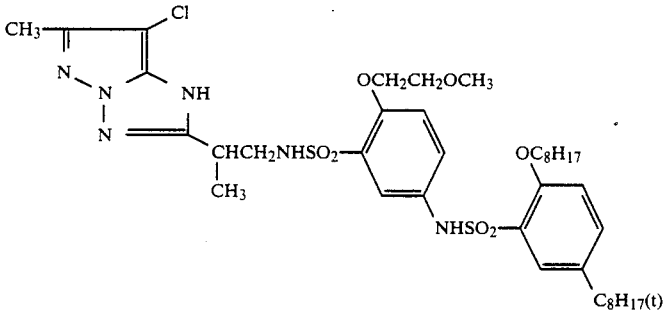
(M-67)
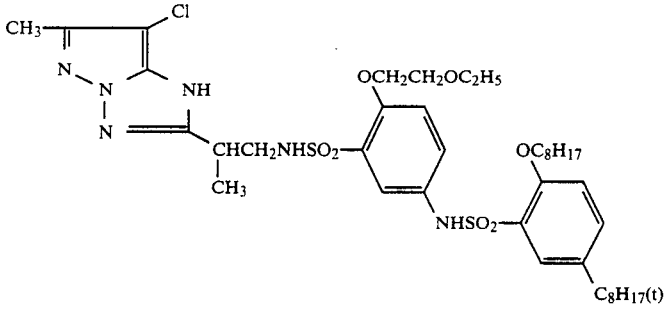
(M-68)
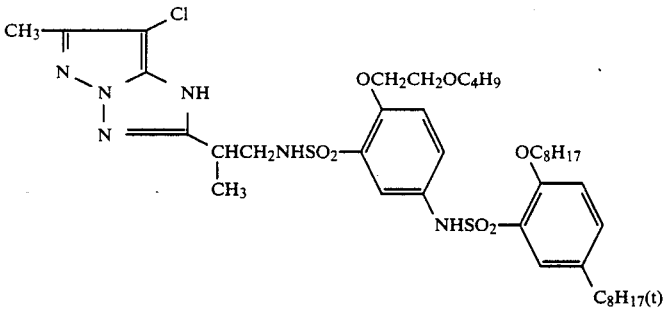
(M-69)
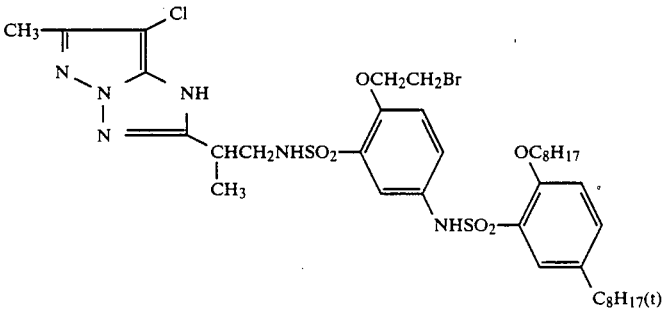

-continued
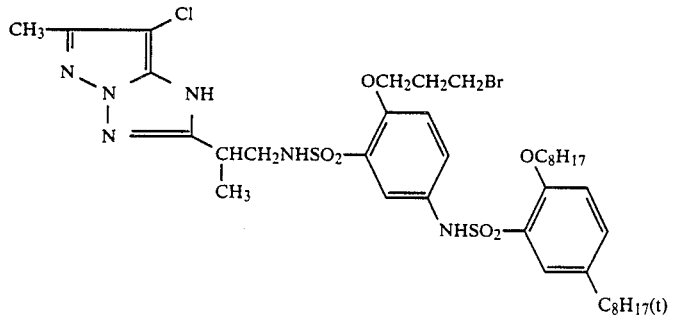
(M-70)
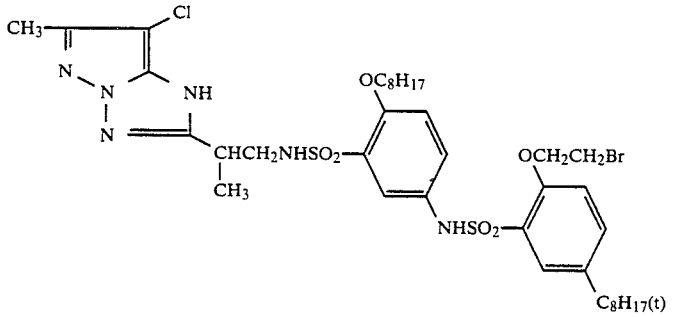
(M-71)
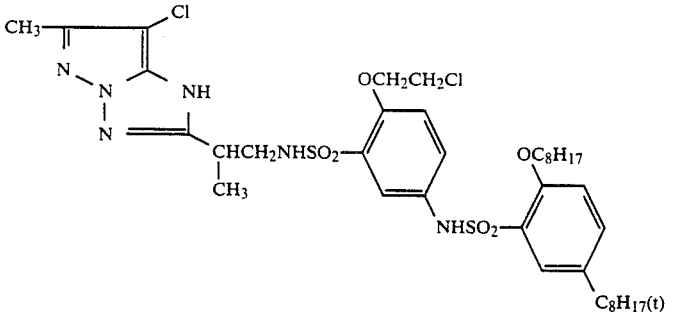
(M-72)
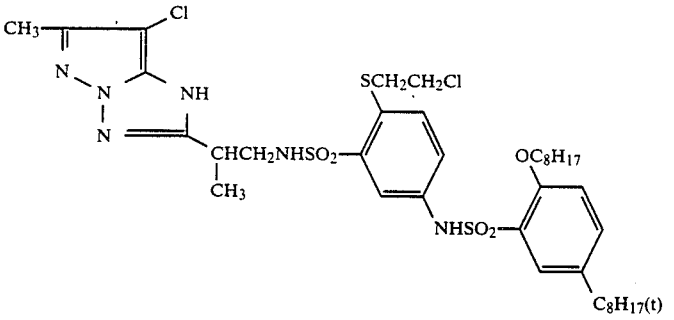
(M-73)
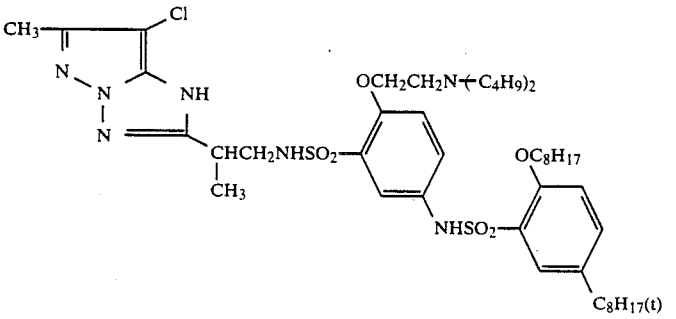
(M-74)

-continued
(M-75)
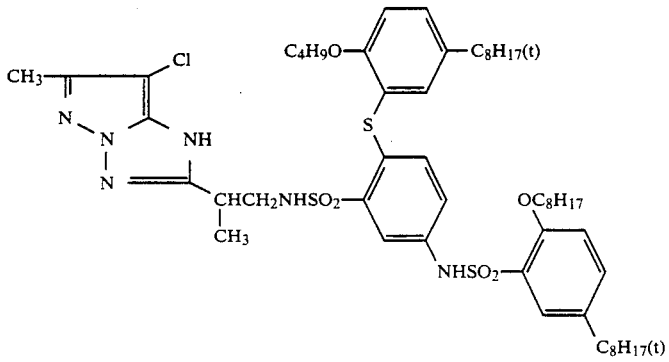
(M-76)
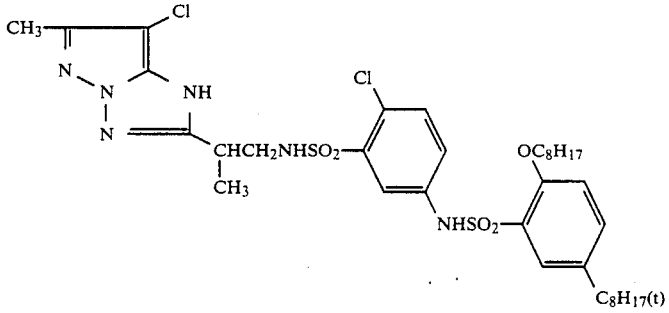
(M-77)
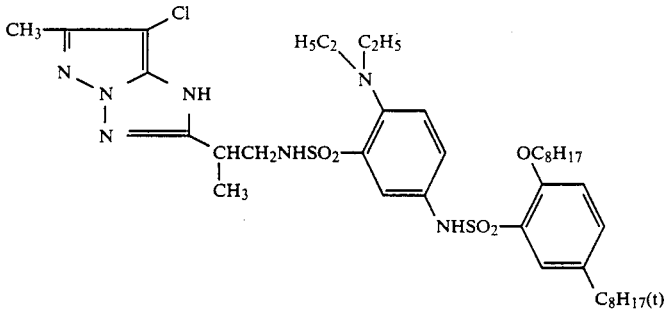
(M-78)
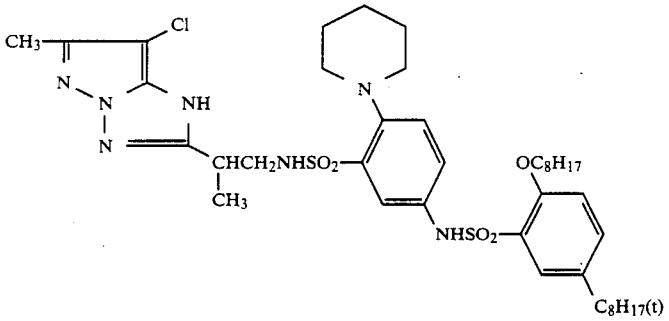
(M-79)
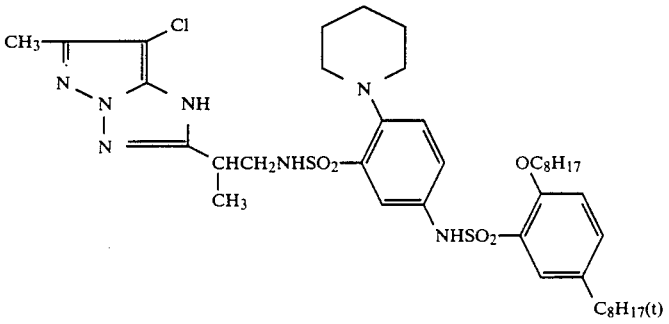

-continued
(M-80)
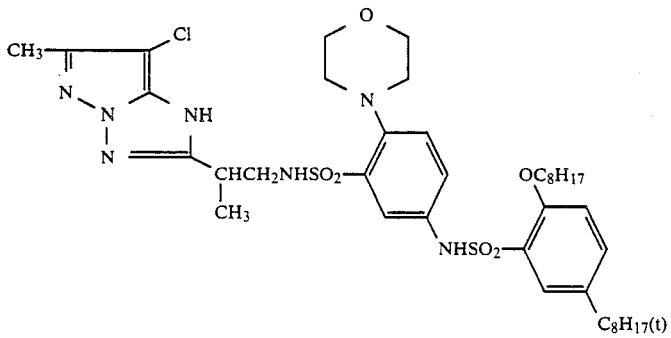
(M-81)
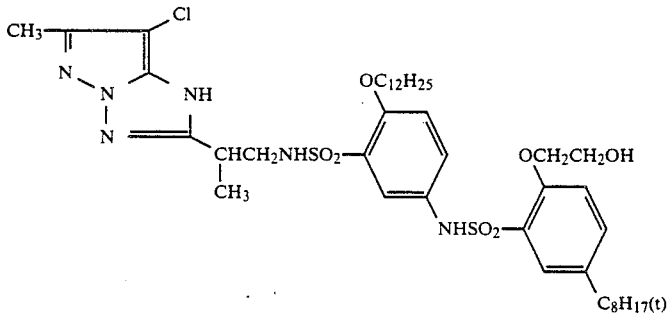
(M-82)
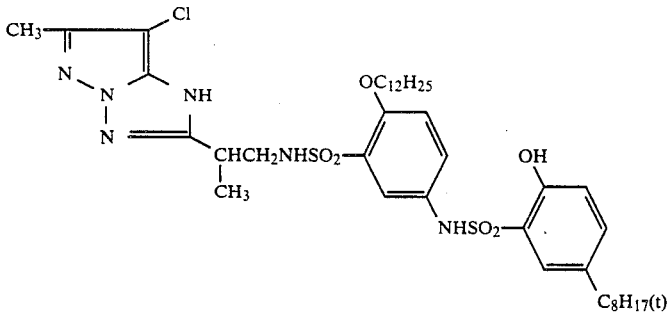
(M-83)
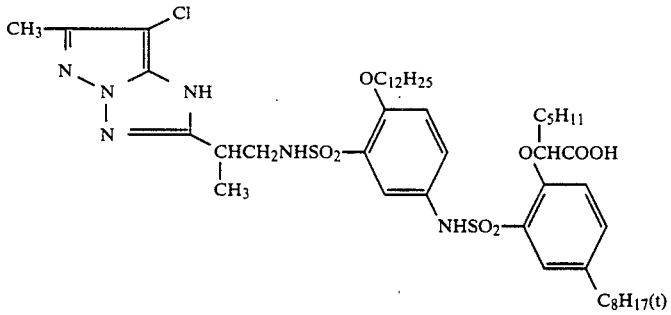
(M-84)
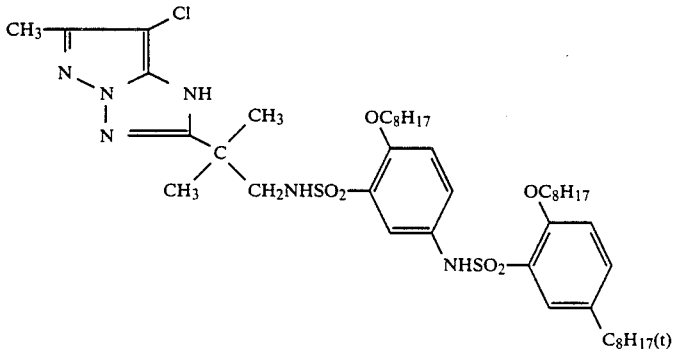

-continued
(M-85)
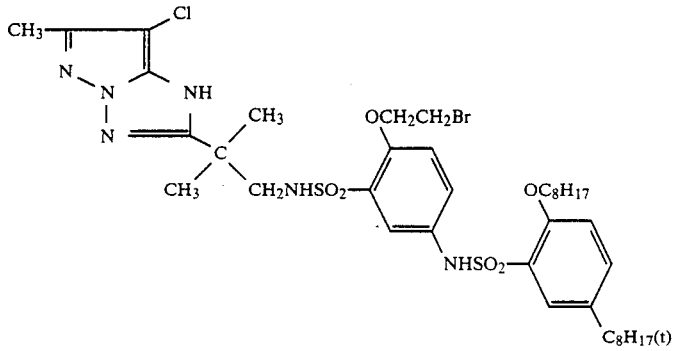
(M-86)
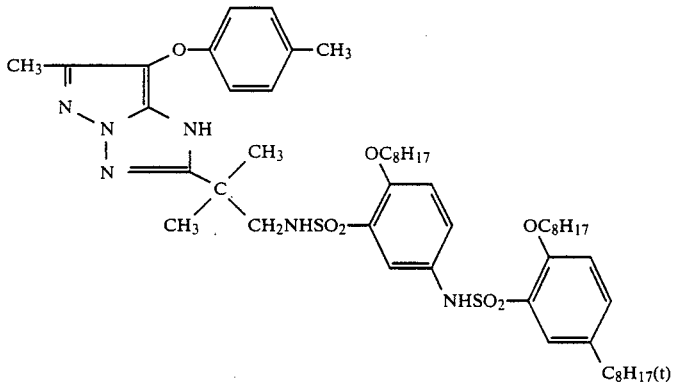
(M-87)
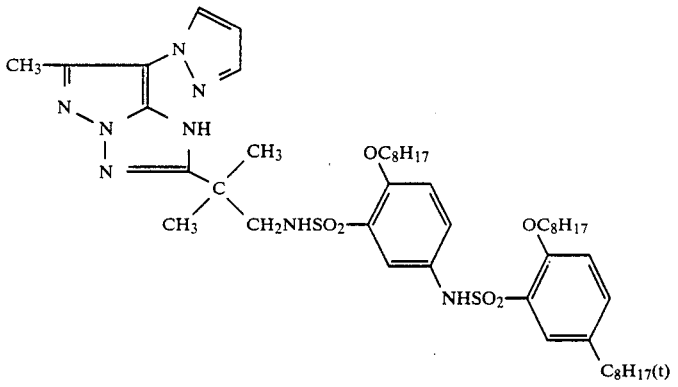
(M-88)
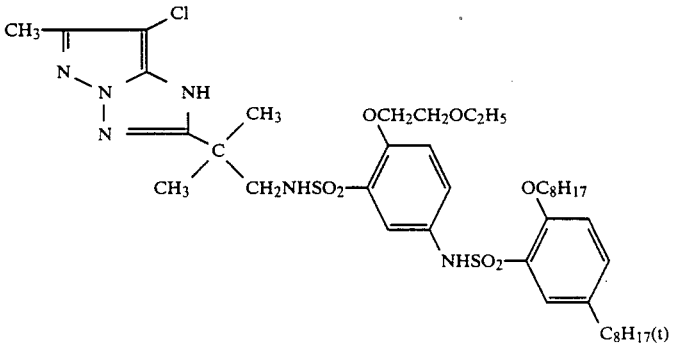

-continued
(M-89)
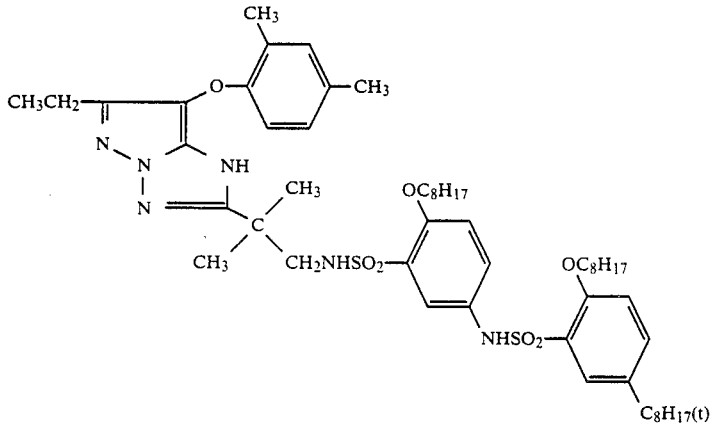
(M-90)
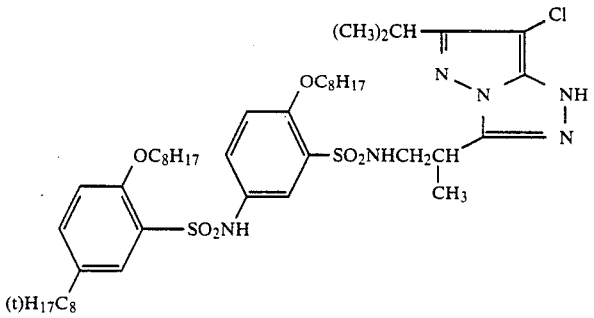
(M-91)
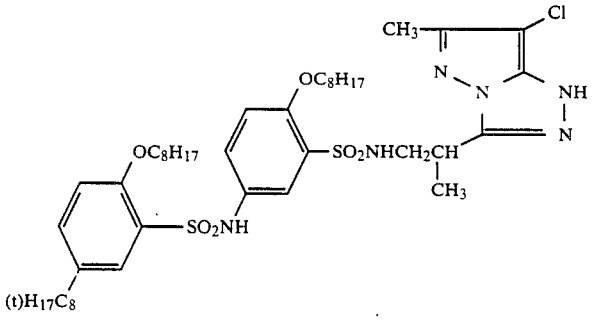
(M-92)
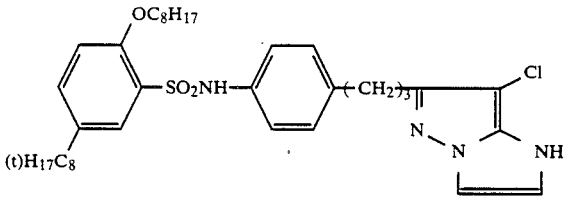
(M-93)
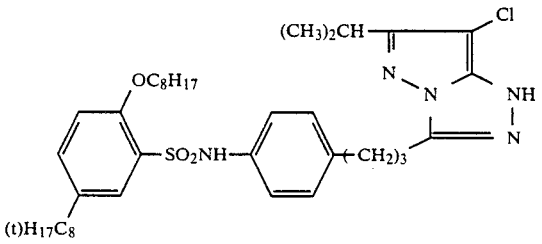

-continued
(M-94)
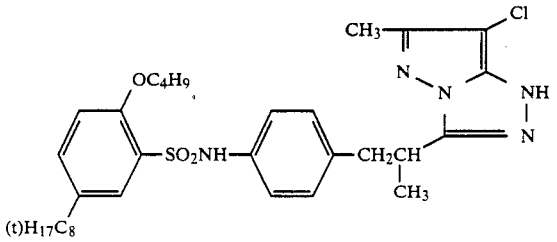
(M-95)
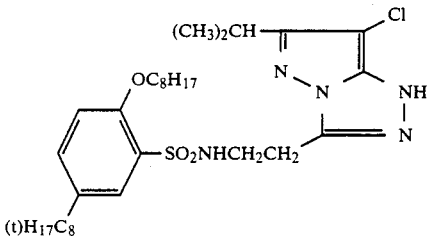
(M-96)
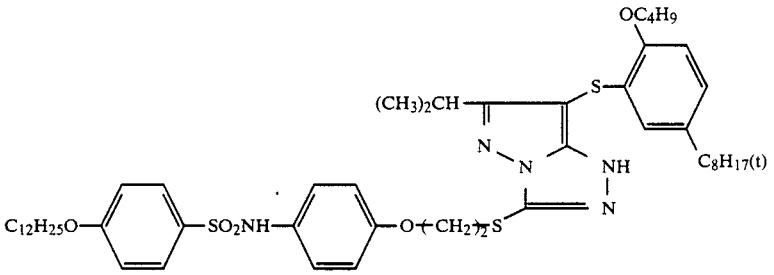
(M-97)
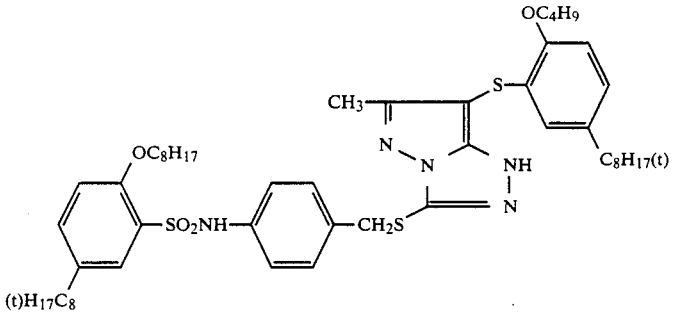
(M-98)
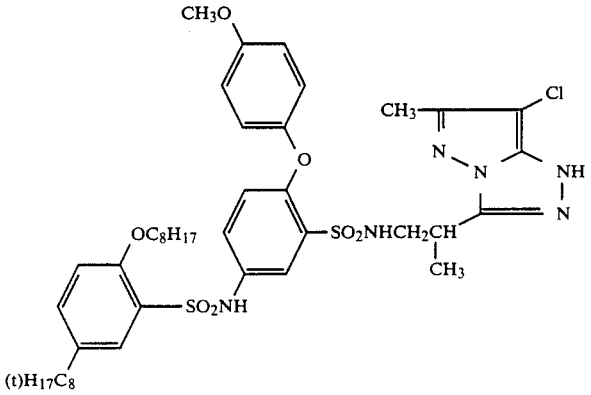

-continued
(M-99)
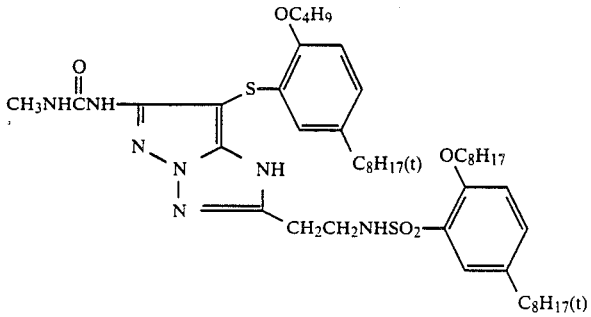
(M-100)
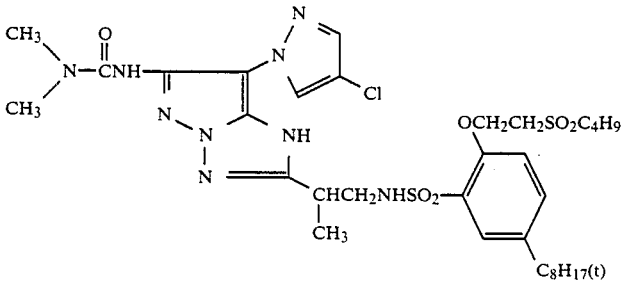
(M-101)
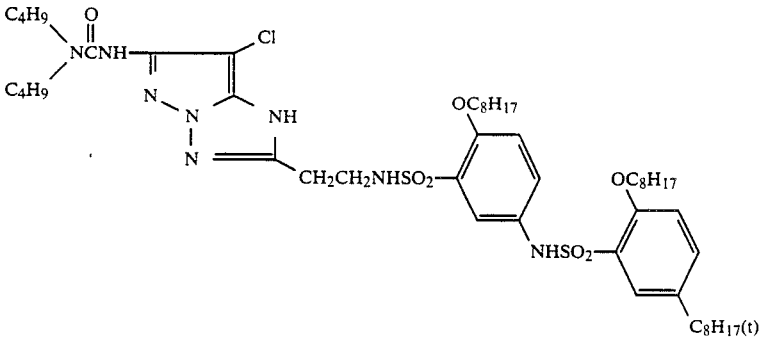
(M-102)
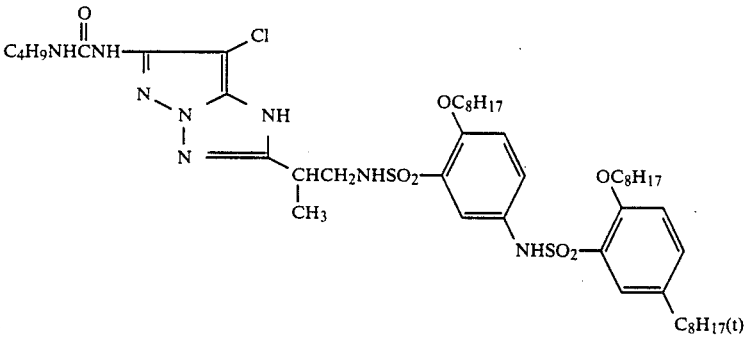
(M-103)
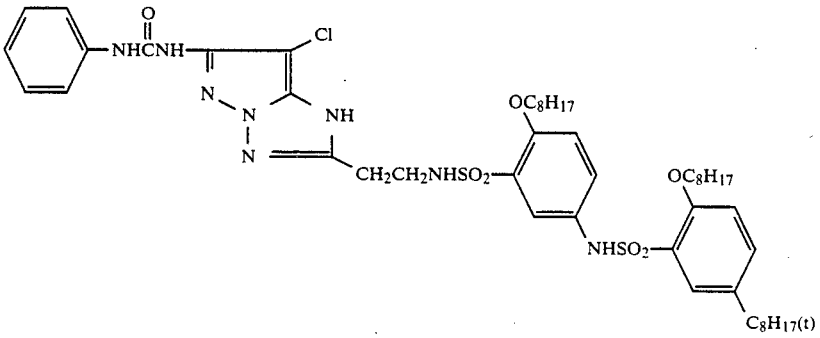

-continued (M-104)

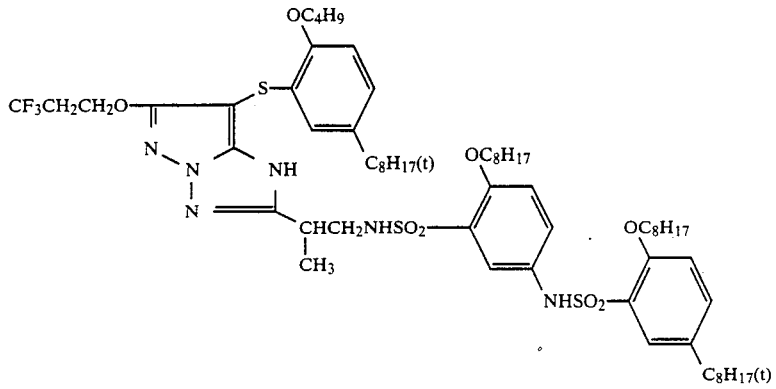

The coupler according to the present invention may be incorporated into a silver halide emulsion layer in an amount of from $1\times10^{-3}$ to $5\times10^{-1}$ mol, and preferably from $5\times10^{-2}$ to $5\times10^{-1}$ mol, per mol of silver present in the emulsion layer.

In order to fulfill characteristics required for the light-sensitive material, two or more kinds of the couplers described above can be incorporated into the same layer.

In order to introduce couplers into a silver halide emulsion layer, known methods, for example, the method as described in U.S. Pat. No. 2,322,027, can be utilized. For example, they can be dissolved into a solvent and then dispersed into a hydrophilic colloid. Examples of solvents usable for this method include organic solvents having a high boiling point, such as alkyl esters of phthalic acid (e.g., dibutyl phthalate, dioctyl phthalate, etc.), phosphonic acid esters (e.g., diphenyl phosphate, triphenyl phosphate, tricresyl phosphate, dioctyl butyl phosphate, etc.), citric acid esters (e.g., tributyl acetyl citrate, etc.), benzoic acid esters (e.g., octyl benzoate, etc.), alkylamides (e.g., diethyl laurylamides, etc.), fatty acids esters (e.g., dibutoxyethyl succinate, diethyl azelate, etc.) and trimesic acid esters (e.g., tributyl trimesate, etc.); and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, $\beta$-ethoxyethyl acetate, methyl cellosolve acetate, or the like. Mixtures of the organic solvents having a high boiling point described above and the organic solvents having a low boiling point described above can also be used.

As described above, it is preferred that the color developing solution which can be employed in the present invention contains an organic phosphonic acid type chelating agent.

Specific examples of the organic phosphonic acid type chelating agents which can be used in the present invention are set forth below, but the present invention should not be construed as being limited thereto.

P-1: 1-Hydroxyethylidene-1,1-diphosphonic acid

P-2: Nitrilo-N,N,N-trimethylenephosphonic acid

P-3: Ethylenediamine-N,N,N',N'-tetramethylenephosphonic acid

The amount of the chelating agent to be added is from $1\times10^{-5}$ to $1\times10^{-1}$ mol, preferably from $1\times10^{-4}$ to $1\times10^{-2}$ mol, per liter of the color developing solution.

In the case of using the organic phosphonic acid type chelating agent, a metal salt such as an aluminum salt or a nickel salt, etc., a lithium salt, or other chelating agents may be employed together therewith for the purpose of preventing precipitation due to calcium ions.

The silver halide emulsion which can be used in the present invention contains silver halide preferably having a silver chloride content of not less than 95 mol %, and preferably does not substantially contain silver iodide. The term "substantially not containing silver iodide" in the present invention means that the silver halide emulsion contains silver iodide in a concentration of 2% by mol or less, preferably 1% by mol or less, most preferably 0% by mol. It is preferred that all of blue-sensitive, green-sensitive and red-sensitive silver halide emulsion layers are composed of silver halide emulsions containing silver halide having a silver chloride content of not less than 95 mol %.

Silver halide grains which can be used in the present invention may have different layers in the inner portion and the surface portion, multiphase structures containing junctions or may be uniform throughout the grains. Further, a mixture of these silver halide grains having different structures may be employed.

Average grain size of silver halide grains used in the present invention (the grain size being defined as grain diameter if the grain has a spherical or a nearly spherical form and as a length of the edge if the grain has a cubic form, and being averaged based on projected areas of the grains) is preferably from 0.1 $\mu$m to 2 $\mu$m, and particularly from 0.15 $\mu$m to 1.5 $\mu$m. Grain size distribution may be either narrow or broad.

It is preferred to employ a so-called monodispersed silver halide emulsion in which a coefficient of variation which is obtained by dividing a standard deviation derived from a grain size distribution curve of a silver halide emulsion by an average grain size is 20% or less and particularly 15% or less in the present invention.

Further, in order to achieve the desired gradation of the light-sensitive material, two or more monodispersed silver halide emulsions which have substantially the same spectral sensitivity but have different grain sizes from each other can be mixed in one emulsion layer, or can be coated in the form of superimposed layers (regarding monodispersibility, the coefficient of variation described above is preferred). Moreover, two or more polydispersed silver halide emulsions or combinations of a monodispersed emulsion and a polydispersed emulsion may be employed in a mixture or in the form of superimposed layers.

Silver halide grains which can be used in the present invention may have a regular crystal structure, for example, a cubic, octahedral, dodecahedral or tetradecahedral structure, etc., an irregular crystal structure, for example, a spherical structure, etc., or a composite structure thereof. It is preferred to employ silver halide grains having a regular crystal structure such as a cubic or tetradecahedral structure. Further, tabular silver halide grains can be used. Particularly preferred is a silver halide emulsion wherein tabular silver halide grains having a ratio of diameter/thickness of not less than 5 (i.e., not less than 5/1), and more preferably not less than 8, account for at least 50% of the total projected area of the silver halide grains present. In addition, mixtures of silver halide grains having different crystal structures may be used. These silver halide emulsions may be those of surface latent image type in which latent images are formed mainly on the surface thereof, those of internal latent image type in which latent images are formed mainly in the interior thereof. It is preferred to employ such silver halide emulsions of surface latent image type.

It is preferred that the silver halide emulsion containing silver halide having a silver chloride content of not less than 90 mol % according to the present invention further incorporates a stabilizer or antifoggant such as mercaptoazoles, more preferably 1-phenyl-5-mercaptotetrazoles.

Photographic emulsions as used in the present invention can be prepared in a conventional manner, for example, by the methods as described in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964), etc. Any of an acid process, a neutral process, an ammonia process, etc., can be employed.

Soluble silver salts and soluble halogen salts can be reacted by techniques such as a single jet process, a double jet process, and a combination thereof. In addition, there can be employed a method (a so-called reversal mixing process) in which silver halide grains are formed in the presence of an excess of silver ions. As one system of the double jet process, a so-called controlled double jet process in which the pAg in a liquid phase where silver halide is formed is maintained at a predetermined level can be employed. This process can prepare a silver halide emulsion in which the crystal form is regular and the particle size is nearly uniform.

Further, a silver halide emulsion which is prepared by a so-called conversion method containing a process in which silver halide previously formed is converted to silver halide having a lower solubility product before the completion of formation of silver halide grains, or a silver halide emulsion which is subjected to similar halogen conversion after the completion of formation of silver halide grains, may also be employed.

During the step of formation or physical ripening of silver halide grains, cadmium salts, zinc salts, lead salts, thallium salts, iridium salts or complex salts thereof, rhodium salts or complex salts thereof, iron salts or complex salts thereof, etc., may be present therewith in order to prevent a failure of the reciprocity law, increase a sensitivity or speed, control a gradation and the like.

After the formation of silver halide grains, silver halide emulsions are usually subjected to physical ripening, removal of soluble salts, and chemical ripening, and are then employed for coating.

Known silver halide solvents (for example, ammonia, potassium thiocyanate, and thioethers and thione compounds as described in U.S. Pat. No. 3,271,157, Japanese Patent Application (OPI) Nos. 12360/76, 82408/78, 144319/78, 100717/79 and 155828/79, etc.) can be employed during the step of formation (precipitation), physical ripening, or chemical ripening of silver halide.

For removal of soluble silver salts from the emulsion after physical ripening, a noodle washing process, a flocculation process or an ultrafiltration process, etc., can be employed.

To the silver halide emulsion which can be used in the present invention, a sulfur sensitization method using active gelatin or compounds containing sulfur capable of reacting with silver (for example, thiosulfates, thioureas, mercapto compounds and rhodanines, etc.), a reduction sensitization method using reducing substances (for example, stannous salts, amines, hydrazine derivatives, formamidinesulfonic acid and silane compounds, etc.), a noble metal sensitization method using noble metal compounds (for example, complex salts of Group VIII metals in the Periodic Table, such as Pt, Ir, Pd, Rh, Fe, etc., as well as gold complex salts); and so forth can be applied alone or in combination with each other.

Of the above-described chemical sensitizations, a sulfur sensitization alone is preferred.

Each of blue-sensitive, green-sensitive and red-sensitive emulsions used in the present invention can be spectrally sensitized with methine dyes or other dyes so as to have each color sensitivity. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nuclues, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus, a thiobarbituric acid nucleus, and the like, as nuclei having a ketomethylene structure.

These sensitizing dyes can be employed individually, and can also be employed in combination. A combination of sensitizing dyes is often used particularly for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but rather exhibit a supersensitizing effect, or materials which do not substantially absorb visible light but exhibit a supersensitizing effect.

It is preferable that couplers which are incorporated into photographic light-sensitive materials are diffusion resistant by means of containing a ballast group or polymerizing. It is also preferred that the coupling active positions of couplers are substituted with a group capable of being released (2-equivalent couplers) other than a hydrogen atom (4-equivalent couplers), from the standpoint that a coating amount of silver is reduced. Further, couplers which form dyes having an appropriate diffusibility, non-color forming couplers, or couplers capable of releasing development inhibitors (DIR couplers) or development accelerators accompanying with the coupling reaction can be employed.

As typical yellow couplers used in the present invention, oil protected acylacetamide type couplers are exemplified. Specific examples thereof are described in U.S. Pat. Nos. 2,407,210, 2,875,057 and 3,265,506, etc. In the present invention 2-equivalent yellow couplers are preferably employed and typical examples thereof include yellow couplers of oxygen atom-releasing type as described in U.S. Pat. Nos. 3,408,194, 3,447,928, 3,933,501 and 4,022,620, etc., and yellow couplers of nitrogen atom-releasing type as described in Japanese Patent Publication No. 10739/83, U.S. Pat. Nos. 4,401,752 and 4,326,024, *Research Disclosure*, No. 18053 (April, 1979), British Patent No. 1,425,020, West German Patent Application (OLS) Nos. 2,219,917, 2,261,361, 2,329,587 and 2,433,812, etc. α-Pivaloylacetanilide type couplers are characterized by good fastness, particularly good light fastness, of dyes formed, and α-benzoylacetanilide type couplers are characterized by providing a high color density.

As magenta couplers used in the present invention, while the pyrazoloazole type magenta couplers represented by formula (I) are most preferred, oil-protected indazolone type couplers, cyanoacetyl type couplers, and preferably 5-pyrazolone type couplers (and pyrazoloazole type couplers such as pyrazolotriazoles) are also employed. Of 5-pyrazolone type couplers, those substituted with an arylamino group or an acylamino group at the 3-position thereof are preferred in view of hue and a color density of dyes formed. Typical examples thereof are described in U.S. Pat. Nos. 2,311,082, 2,343,703, 2,600,788, 2,908,573, 3,062,653, 3,152,896 and 3,936,015, etc. 2-Equivalent 5-pyrazolone type couplers are preferably used. Particularly, nitrogen atom-releasing groups as described in U.S. Pat. No. 4,310,619 and arylthio groups as described in U.S. Pat. No. 4,351,897 are preferred as releasing groups. Further, 5-pyrazolone type couplers having a ballast group as described in European Patent No. 73,636 are advantageous because they provide a high color density.

As cyan couplers used in the present invention, oil-protected naphthol type and phenol type couplers are exemplified. Typical examples thereof include naphthol type couplers as described in U.S. Pat. No. 2,474,293 and preferably oxygen atom-releasing type 2-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers fast to humidity and temperature are preferably used in the present invention. Typical examples thereof include phenol type cyan couplers having an alkyl group more than a methyl group at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729, and Japanese Patent Application (OPI) No. 166956/84, etc., and phenol type couplers having a phenylureido group at the 2-position thereof and an acylamino group at the 5-position thereof as described in U.S. Pat. Nos. 3,446,622, 4,333,999, 4,451,559 and 4,427,767, etc.

Further, couplers capable of forming appropriately diffusible dyes can be used together in order to improve graininess. Specific examples of such dye diffusible types of magenta couplers are described in U.S. Pat. No. 4,366,237 and British Patent No. 2,125,570, etc., and those of yellow, magenta and cyan couplers are described in European Patent No. 96,570 and West German Patent Application (OLS) No. 3,234,533, etc.

These dye-forming couplers and special couplers described above may be used in the form of dimers or higher polymers. Typical examples of dye-forming polymeric couplers are described in U.S. Pat. Nos. 3,451,820 and 4,080,211, etc. Specific examples of magenta polymeric couplers are described in British Patent No. 2,102,173 and U.S. Pat. No. 4,367,282, etc.

Two or more kinds of various couplers which can be used in the present invention can be incorporated together into the same layer for the purpose of satisfying the properties required of the color photographic light-sensitive material, or the same compound can be incorporated into two or more different layers.

The couplers which can be used in the present invention can be incorporated into the color photographic light-sensitive material using a solid dispersing method, an alkali dispersing method, preferably a latex dispersing method and more preferably an oil droplet in water type dispersing method. By means of the oil droplet in water type dispersing method, couplers are dissolved in either an organic solvent having a high boiling point of 175° C. or more, a so-called auxiliary solvent having a low boiling point, or a mixture thereof and then the solution is finely dispersed in an aqueous medium such as water or an aqueous gelatin solution, etc., in the presence of a surface active agent. Specific examples of the organic solvents having a high boiling point are described in U.S. Pat. No. 2,322,027, etc. In order to prepare a dispersion, phase inversion may be accompanied. Further, dispersions are utilized for coating after removing or reducing the auxiliary solvent therein by distillation, noodle washing or ultrafiltration, etc., if desired.

Specific examples of the organic solvent having a high boiling point include phthalic acid esters (for example, dibutyl phthalate, dicyclohexyl phthalate, di-2-ethylhexyl phthalate, didodecyl phthalate, etc.), phosphoric or phosphonic acid esters (for example, triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexyl phenyl phosphonate, etc.), benzoic acid esters (for example, 2-ethylhexyl benzoate, dodecyl benzoate, 2-ethylhexyl-p-hydroxybenzoate, etc.), amides (for example, diethyldodecanamide, N-tetradecylpyrrolidone, etc.), alcohols or phenols (for example, isostearyl alcohol, 2,4-di-tert-amylphenol, etc.), aliphatic carboxylic acid esters (for example, dioctyl azelate, glycerol tributyrate, isostearyl lactate, trioctyl citrate, etc.), aniline derivatives (for example, N,N-dibutyl-2-butoxy-5-tert-octylaniline, etc.), hydrocarbons (for example, paraffin, dodecylbenzene, diisopropylnaphthalene, etc.), etc. As the auxiliary solvents, organic solvents having a boiling point of about 30° C. or more, preferably from about 50° C. to about 160° C., etc., can be used. Typical examples of such auxiliary solvents include ethyl acetate, butyl acetate, ethyl propionate, methyl ethyl ketone, cyclohexanone, 2-ethoxyethyl acetate, dimethylformamide, etc.

The processes and effects of latex dispersing methods and the specific examples of latexes for loading are described in U.S. Pat. No. 4,199,363, West German Patent Application (OLS) Nos. 2,541,274 and 2,541,230, etc.

The color couplers are generally employed in an amount of 0.001 mol to 1 mol per mol of light-sensitive silver halide contained in a layer to be added. It is preferred that amounts of yellow couplers, magenta couplers, and cyan couplers used are in ranges of 0.01 mol to 0.5 mol, 0.003 mol to 0.3 mol, and 0.002 mol to 0.3 mol, per mol of light-sensitive silver halide, respectively.

The color photographic light-sensitive material used in the present invention may contain hydroquinone derivatives, aminophenol derivatives, amines, gallic acid derivatives, catechol derivatives, ascorbic acid derivatives, non-color forming couplers, sulfonamidophenol derivatives, etc., as color fog preventing agents or color mixing preventing agents.

In the color photographic light-sensitive material used in the present invention, various known color fading preventing agents can be employed. Typical examples of organic color fading preventing agents include hindered phenols, for example, hydroquinones, 6-hydroxychromans, 5-hydroxycoumarans, spirochromans, p-alkoxyphenols, bisphenols, etc., gallic acid derivatives, methylenedioxybenzenes, aminophenols, hindered amines, or ether or ester derivatives thereof derived from each of these compounds by silylation or alkylation of the phenolic hydroxy group thereof. Further, metal complexes represented by (bissalicylaldoxymate) nickel complexes and (bis-N,N-dialkyldithiocarbamate) nickel complexes may be employed.

For the purpose of preventing degradation of yellow dye images due to heat, humidity and light, compounds each having both a hindered amine partial structure and a hindered phenol partial structure in its molecule, as described in U.S. Pat. No. 4,268,593, provide good results. For the purpose of preventing degradation of magenta dye images, particularly degradation due to light, spiroindans as described in Japanese Patent Application (OPI) No. 159644/81, chromans substituted with a hydroquinone diether or monoether as described in Japanese Patent Application (OPI) No. 89835/80 provide preferred results.

In order to improve preservability, particularly light fastness of cyan dye images, it is preferred to employ together a benzotriazole type ultraviolet ray absorbing agent. Such an ultraviolet ray absorbing agent may be emulsified together with a cyan coupler. The coating amount of the ultraviolet ray absorbing agent is selected so as to sufficiently improve the light stability of cyan dye images. When the amount of the ultraviolet ray absorbing agent employed is too large, yellow coloration may occur in unexposed areas (white background areas) of color photographic materials containing them. Therefore, it is usual that the amount is preferably determined in a range from $1\times10^{-4}$ mol/m$^2$ to $2\times10^{-3}$ mol/m$^2$, and particularly from $5\times10^{-4}$ mol/m$^2$ to $1.5\times10^{-3}$ mol/m$^2$.

In color paper having a conventional light-sensitive layer structure, the ultraviolet ray absorbing agent is incorporated into one of two layers adjacent to a red-sensitive emulsion layer containing a cyan coupler, and preferably in both thereof. When the ultraviolet ray absorbing agent is incorporated into an intermediate layer positioned between a green-sensitive emulsion layer and a red-sensitive emulsion layer, it may be emulsified together with a color mixing preventing agent. In the case of adding the ultraviolet ray absorbing agent to a protective layer, another protective layer may be separately provided thereon as the outermost layer. Into the outermost protective layer a matting agent having an appropriate particle size, etc., can be incorporated.

The color photographic light-sensitive material used in the present invention may contain an ultraviolet ray absorbing agent in a hydrophilic colloid layer thereof.

The color photographic light-sensitive material used in the present invention may contain water-soluble dyes as filter dyes or for irradiation or halation prevention or other various purposes in a hydrophilic colloid layer thereof.

The color photographic light-sensitive material used in the present invention may contain in photographic emulsion layers or other hydrophilic colloid layers a brightening agent of the stilbene series, triazine series, oxazole series, or coumarin series, etc. Water-soluble brightening agents can be employed. Also, water-insoluble brightening agents may be used in the form of a dispersion.

The present invention can be applied to a multilayer multicolor photographic light-sensitive material having at least two differently spectrally sensitized silver halide photographic emulsion layers on a support, as described above. The multilayer natural color photographic light-sensitive material usually has at least one red-sensitive silver halide emulsion layer, at least one green-sensitive silver halide emulsion layer, and at least one blue-sensitive silver halide emulsion layer on a support. The order of the disposition of these emulsion layers can be suitably selected depending on the particular demand.

A conventional disposition is that a blue-sensitive emulsion layer, a green-sensitive emulsion layer and a red-sensitive emulsion layer are arranged in this order from the support side. However, for instance, it is preferred to arrange a blue-sensitive emulsion layer of the three layers at the farthest position from the support when considering a balance of color fading to light in three layers. Further, each of the above-described emulsion layers may be composed of two or more emulsion layers having different sensitivities. Moreover, between two or more emulsion layers sensitive to the same spectral wavelength range, a light-insensitive layer may be present.

In the color photographic light-sensitive material according to the present invention, it is preferred to provide a subsidiary layer such as a protective layer, intermediate layer, a filter layer, an antihalation layer, a back layer, etc., appropriately, in addition to the silver halide emulsion layer.

As the binder or the protective colloid for the photographic emulsion layers or intermediate layers of the color photographic light-sensitive material according to the present invention, gelatin is advantageously used, but other hydrophilic colloids can also be used.

For example, it is possible to use proteins such as gelatin derivatives, graft polymers of gelatin and other polymers, albumin, casein, etc.; saccharides, for example, cellulose derivatives such as hydroxyethyl cellulose, carboxymethyl cellulose, cellulose sulfate, etc., sodium alginate, starch derivatives, etc.; and various synthetic hydrophilic polymeric substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinylimidazole, polyvinylpyrazole, etc.

As gelatin, not only lime-processed gelatin, but also acid-processed gelatin and enzyme-processed gelatin as described in *Bull. Soc. Sci. Phot. Japan*, No. 16, page 30 (1966) may be used. Further, hydrolyzed products of gelatin or enzymatically decomposed products of gelatin can also be used.

Moreover, into the color photographic light-sensitive material according to the present invention can be incorporated various kinds of stabilizers, contamination preventing agents, developing agents or precursors thereof, development accelerating agents or precursors thereof, lubricants, mordants, matting agents, antistatic agents, plasticizers or other additives useful for photographic light-sensitive materials in addition to the above-described additives. Typical examples of these additives are described in *Research Disclosure*, RD No. 17643 (Dec., 1978) and ibid., RD No. 18716 (Nov., 1979).

The expression "reflective support" which can be employed in the present invention means a support having an increased reflection property for the purpose of rendering dye images formed in the silver halide emulsion layer clear. Examples of the reflective support include a support having coated thereon a hydrophobic resin containing a light reflective substance such as titanium oxide, zinc oxide, calcium carbonate, calcium sulfate, etc., dispersed therein and a support composed of a hydrophobic resin containing a light reflective substance dispersed therein. More specifically, they include baryta coated paper, polyethylene coated paper, polypropylene type synthetic paper, a transparent support, for example, a glass plate, a polyester film such as a polyethylene terephthalate film, a cellulose triacetate film, a cellulose nitrate film, etc., a polyamide film, a polycarbonate film, a polystyrene film, etc., having a reflective layer or having incorporated therein a reflective substance. A suitable support can be appropriately selected depending on the intended use.

A color developing solution which can be used in development processing of the color photographic light-sensitive material according to the present invention is an alkaline aqueous solution containing preferably an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfate, hydrochloride, phosphate, p-toluenesulfonate, tetraphenylborate or p-(tert-octyl) benzenesulfonate thereof, etc., more preferably 3-methyl-4-amino-N-ethyl-N-3-hydroxyethylaniline and 3-methyl-4-amino-N-ethyl-N-3-methanesulfonamidoethylaniline, most preferably 3-methyl-4-amino-N-ethyl-N-β-methanesulfonamidoethylaniline. These diamines are preferably employed in the form of salts since the salts are generally more stable than the free forms.

The aminophenol type derivatives include, for example, o-aminophenol, p-aminophenol, 4-amino-2-methylphenol, 2-amino-3-methylphenol, 2-oxy-3-amino-1,4-dimethylbenzene, etc.

In addition, the compounds as described in L. F. A. Mason, *Photographic Processing Chemistry*, The Focal Press, pages 226 to 229 (1966), U.S. Pat. Nos. 2,193,015 and 2,592,364, Japanese Patent Application (OPI) No. 64933/73, etc., may be used.

Two or more kinds of color developing agents may be employed in a combination thereof, if desired.

The color developing solution can further contain pH buffering agents, such as carbonates, borates, or phosphates of alkali metals, etc.; development inhibitors or antifogging agents such as bromides, benzimidazoles, benzothiazoles or mercapto compounds, etc.; preservatives such as hydroxylamine, triethanolamine, the compounds as described in West German Patent Application (OLS) No. 2,622,950, sulfites, bisulfites, etc.; organic solvents such as diethylene glycol, etc.; development accelerators such as polyethylene glycol, quaternary ammonium salts, amines, thiocyanates, 3,6-dithiaoctane-1,8-diol, etc.; dye-forming couplers; competing couplers; nucleating agents such as sodium borohydride, etc.; auxiliary developing agents such as 1-phenyl-3-pyrazolidone, etc.; viscosity imparting agents; and chelating agents including aminopolycarboxylic acids represented by ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, the compounds as described in Japanese Patent Application (OPI) No. 195845/83, etc., phosphonocarboxylic acids as described in Japanese Patent Application (OPI) Nos. 102726/77, 42730/78, 121127/79, 4024/80, 4025/80, 126241/80, 65955/80 and 65956/80, *Research Disclosure*, RD No. 18170 (May, 1979), etc.

The color developing agent can be used in an amount ranging generally from about 0.1 g to about 30 g, and preferably from about 1 g to about 15 g, per liter of the color developing solution. The pH of the color developing solution used is usually 7 or more, and preferably in a range from about 9 to about 13. Further, an amount of replenishment for the color developing solution can be reduced using a replenisher in which the concentrations of halogenides, color developing agents, etc., are controlled.

In the case of development processing for reversal color photographic light-sensitive materials, color development is usually conducted after black-and-white development. In a black-and-white developing solution, known black-and-white developing agents, for example, dihydroxybenzenes such as hydroquinone, hydroquinone monosulfonate, etc., 3-pyrazolidones such as 1-phenyl-3-pyrazolidone, etc., or aminophenols such as N-methyl-p-aminophenol, etc., may be employed individually or in a combination.

After color development, the photographic emulsion layer is usually subjected to a bleach-fix processing.

Bleaching agents which can be used in the bleach-fix processing include compounds of polyvalent metals, for example, iron (III), cobalt (III), chromium (VI), and copper (II), etc. (for example, ferricyanides, etc.); peracids; quinones; nitroso compounds; dichromates; organic complex salts of iron (III) or cobalt (III), for example, complex salts of aminopolycarboxylic acids (e.g., ethylenediaminetetraacetic acid, diethylenetriaminepentaacetic acid, etc.), aminopolyphosphonic acids, phosphonocarboxylic acids and organic phosphonic acids, etc., or complex salts of organic acids (e.g., citric acid, tartaric acid, malic acid, etc.); persulfates; hydrogen peroxide; permanganates; etc. Of these compounds, organic complex salts of iron (III) are preferred in view of a rapid processing and less environmental pollution.

Specific examples of useful aminopolycarboxylic acids, aminopolyphosphonic acids or salts thereof suitable for forming organic complex salts of iron (III) are set forth below.

Ethylenediaminetetraacetic acid
Diethylenetriaminepentaacetic acid
Ethylenediamine-N-(β-oxyethyl)-N,N',N'-triacetic acid
1,2-Diaminopropanetetraacetic acid
Triethylenetetraminehexaacetic acid
Propylenediaminetetraacetic acid
Nitrilotriacetic acid
Nitrilotripropionic acid
Cyclohexanediaminetetraacetic acid
1,3-Diamino-2-propanoltetraacetic acid
Methyliminodiacetic acid
Iminodiacetic acid
Hydroxyliminodiacetic acid
Dihydroxyethylglycine
Ethyl ether diaminetetraacetic acid
Glycol ether diaminetetraacetic acid
Ethylenediaminetetrapropionic acid
Ethylenediaminedipropionic acid
Phenylenediaminetetraacetic acid
2-Phosphonobutane-1,2,4-triacetic acid
1,3-Diaminopropanol-N,N,N',N'-tetramethylenephosphonic acid
Ethylenediamine-N,N,N',N'-tetramethylenephosphonic acid
1,3-Propylenediamine-N,N,N',N'-tetramethylenephosphonic acid
1-Hydroxyethylidene-1,1'-diphosphonic acid.

Of these compounds, iron (III) complex salt of ethylenediaminetetraacetic acid, diethylenetriaminepentaacetic acid, cyclohexanediaminetetraacetic acid, 1,2-diaminopropanetetraacetic acid or methyliminodiacetic acid are preferred because of their high bleaching power.

The iron (III) complex salts may be used in the form of a complex salt per se or may be formed in situ in solution by using an iron (III) salt (e.g., ferric sulfate, ferric chloride, ferric nitrate, ferric ammonium sulfate or ferric phosphate, etc.) and a chelating agent (e.g., an aminopolycarboxylic acid, an aminopolyphosphonic acid or a phosphonocarboxylic acid, etc.). When they are used in the form of a complex salt, they may be used alone or as a combination of two or more. On the other hand, where a complex is formed in situ in solution by using a ferric salt and a chelating agent, one, two or more ferric salts may be used. Further, one, two or more chelating agents may also be used. In every case, a chelating agent may be used in an excess amount of that necessary for forming a ferric ion complex salt.

A bleach-fixing solution containing the above-described ferric ion complex may further contain metal ions or complexes of metals other than iron such as calcium, magnesium, aluminum, nickel, bismuth, zinc, tungsten, cobalt, copper, etc., or hydrogen peroxide.

The bleach-fixing solution used in the present invention can contain rehalogenating agents such as bromides (e.g., potassium bromide, sodium bromide, ammonium bromide, etc.) or chlorides (e.g., potassium chloride, sodium chloride, ammonium chloride, etc.). Further, one or more kinds of inorganic acids, organic acids, alkali metal salts thereof or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.), corrosion preventing agents (e.g., ammonium nitrate, guanidine, etc.), or the like may be added.

The amount of bleaching agent is preferably from 0.1 to 2 mols per liter of the bleach-fixing solution, and the pH of the bleach-fixing solution is preferably from 4.0 to 9.0, when a ferric ion complex salt is used, and particularly from 5.0 to 8.0, when a ferric ion complex salt of an aminopolycarboxylic acid, aminopolyphosphonic acid, phosphonocarboxylic acid or organic phosphonic acid is used.

As fixing agents which can be employed in the bleach-fixing solution, known fixing agents, that is, water-soluble silver halide solvents such as thiosulfates (e.g., sodium thiosulfate, ammonium thiosulfate, etc.); thiocyanates (e.g., sodium thiocyanate, ammonium thiocyanate, etc.); thioether compounds (e.g., ethylenebisthioglycolic acid, 3,6-dithia-1,8-octanediol, etc.); and thioureas may be used individually or as a combination of two or more. In addition, a special bleach-fixing solution comprising a combination of fixing agent and a large amount of a halide compound such as potassium iodide as described in Japanese Patent Application (OPI) No. 155354/80 can be used as well.

In the bleach-fixing solution, it is desirable that the amount of fixing agent is from 0.2 to 4 mols per liter of the bleach-fixing solution.

The bleach-fixing solution can contain preservatives such as sulfites (e.g., sodium sulfite, potassium sulfite, ammonium sulfite, etc.), bisulfites, hydroxylamines, hydrazines, aldehyde-bisulfite adducts (e.g., acetaldehyde-sodium bisulfite adduct), etc. Further, various fluorescent brightening agents, defoaming agents, surface active agents, polyvinyl pyrrolidone, organic solvents (e.g., methanol, etc.), etc., may be incorporated.

In the bleach-fixing solution or a prebath thereof, a bleach accelerating agent can be used, if desired. Specific examples of suitable bleach accelerating agents include compounds having a mercapto group or a disulfide group as described in U.S. Pat. No. 3,893,858, West German Patent Application (OLS) Nos. 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78 and 28426/78, *Research Disclosure*, RD No. 17129 (July, 1978), etc.; thiazolidine derivatives as described in Japanese Patent Application (OPI) No. 140129/75, etc.;

thiourea derivatives as described in Japanese Patent Publication No. 8506/70, Japanese Patent Application (OPI) Nos. 20832/77 and 32735/78, U.S. Pat. No. 3,706,561, etc.; iodides as described in West German Patent No. 1,127,715, Japanese Patent Application (OPI) No. 16235/78, etc.; polyethylene oxides as described in West German Patent Nos. 996,410 and 2,748,430, etc.; polyamine compounds as described in Japanese Patent Publication No. 8836/70, etc.; compounds as described in Japanese Patent Application (OPI) Nos. 42434/74, 59644/74, 94927/78, 35727/79, 26506/80 and 163940/83; and bromine ions. Of these compounds, the compounds having a mercapto group or a disulfide group are preferred in view of their large bleach accelerating effects. Particularly, the compounds as described in U.S. Pat. No. 3,893,858, West German Patent No. 1,290,812 and Japanese Patent Application (OPI) No. 95630/78 are preferred. Further, the compounds as described in U.S. Pat. No. 4,552,834 are also preferred. These bleach accelerating agents may be incorporated into the color photographic light-sensitive material.

After the bleach-fixing step, it is typical to carry out processing steps such as water washing and stabilizing, etc.

In the water washing step or stabilizing step, various known compounds may be employed for the purpose of preventing the formation of precipitation or stabilizing the washing water, if desired. Examples of such additives include a chelating agent such as an inorganic phosphoric acid, an aminopolycarboxylic acid, an organic phosphonic acid, etc., a germicidal agent or an antifungal agent for preventing the propagation of various bacteria, algae and molds (e.g., the compounds as described in *J. Antibact. Antifung. Agents*, Vol. 11, No. 5, pages 207 to 223 (1983) or the compounds as described in Hiroshi Horiguchi, *Boukin Boubai no Kagaku*, etc.), a metal salt represented by a magnesium salt, an aluminum salt, a bismuth salt, etc., an alkali metal or ammonium salt, or a surface active agent for reducing drying load or preventing drying marks, or the like. Further, the compounds as described in L. E. West, *Photo. Sci. and Eng.*, Vol. 6, pages 344 to 359 (1965) may be added thereto.

The water washing step is ordinarily carried out by a multistage countercurrent water washing process using two or more tanks (for example, using two to nine tanks) in order to save on the amount of washing water required.

In place of the water washing step, a multistage countercurrent stabilizing process as described in Japanese Patent Application (OPI) No. 8543/82 can be conducted. To the stabilizing bath to be used, various kinds of compounds may be added for the purpose of stabilizing images formed in addition to the above-described additives. Representative examples of such compounds include various buffers (for example, borates, metaborates, borax, phosphates, carbonates, potassium hydroxide, sodium hydroxide, aqueous ammonia, monocarboxylic acids, dicarboxylic acids, polycarboxylic acids, etc., being used in a combination) in order to adjust pH of layers (for example, pH of 3 to 9), and aldehydes such as formalin, etc. In addition, various additives, for example, a chelating agent (e.g., an inorganic phosphonic acid, an aminopolycarboxylic acid, an organic phosphonic acid, an aminopolyphosphonic acid, a phosphonocarboxylic acid, etc.), a germicidal agent, an antifungal agent (e.g., those of thiazole type, isothiazole type, halogenated phenol type, sulfanylamido type, benzotriazole type, etc.), a surface active agent, a fluorescent brightening agent, a hardening agent, a metal salt, etc., may be employed. Two or more compounds for the same purpose or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as pH adjusting agents for layers after development processing, in order to improve image preservability.

The processing time for water washing step and stabilizing step according to the present invention can be varied depending on the kinds of color photographic light-sensitive materials and processing conditions, but is usually from 20 seconds to 10 minutes, and preferably from 20 seconds to 5 minutes.

Moreover, it is preferred that the amount of replenisher for the washing water or stabilizing solution is from 3 to 50 times of the amount of processing solution carried over from the preceding bath per a unit area of the color photographic light-sensitive material.

In the present invention, various kinds of processing solutions can be employed in a temperature range from 10° C. to 50° C. The temperature ranging from 33° C. to 38° C. is particularly preferred.

Since the time for color development usually occupies a large part in the total processing time, it is most effective to shorten the time for color development in order to reduce the total processing time.

In the method of present invention, a period of the color developing time is preferably from 20 seconds to 2 minutes, and more preferably from 30 seconds to 1 minute and 40 seconds. The term "color developing time" means the period from the time when the photographic light-sensitive material comes into contact with the color developing solution to the time when the photographic material comes into contact with the following processing solution. That is, it includes the transfer time between the processing solutions.

It is well known that the concentration of $Br^-$ ions contained in a color developing solution varies a development speed in a wide range. Thus, in the field of the photographic processing, a standard processing type in which color development is carried out in the KBr concentration of about 0.5 g/liter at 33° C. for 3 minutes and 30 seconds, and a low replenishment type in which color development is carried out in the KBr concentration of about 1 g/liter at 38° C. for 3 minutes and 30 seconds are practiced. In the latter low replenishment case it is necessary to raise the temperature for development at 5° C. by means of the increase in the KBr concentration of from 0.5 g/liter to 1.0 g/liter.

In accordance with the method of the present invention, it is possible to increase a development speed using a color developing solution having a lower KBr concentration since an amount of $Br^-$ ions released from the color photographic light-sensitive material is small. Also, it is possible to employ a color developing solution of low replenishment type by utilizing this small $Br^-$ ion releasing property. Further, an intermediate process between these two types can be selected.

In the color developing solution used in the present invention, the concentration of $Br^-$ ions calculated in terms of KBr ranges preferably from 1.2 g/liter to 0.05 g/liter, more preferably from 0.6 g/liter to 0.08 g/liter, and particularly preferably from 0.4 g/liter to 0.1 g/liter.

Further, for the purpose of saving an amount of silver employed in the color photographic light-sensitive material, the photographic processing may be conducted utilizing color intensification using cobalt or hydrogen peroxide as described in West German Patent Application (OLS) No. 2,226,770 and U.S. Pat. No. 3,674,499, etc., or utilizing a monobath development bleach-fix processing as described in U.S. Pat. No. 3,923,511.

Moreover, each processing time can be shortened than the standard processing time within a range which does not cause any trouble, if desired, for the purpose of acceleration of processing.

For the purpose of simplification and acceleration of processing, a color developing agent or a precursor thereof may be incorporated into the color photographic light-sensitive material used in the present invention. In order to incorporate the color developing agent, it is preferred to employ various precursors of color developing agents from the viewpoint of increasing stability of the color photographic light-sensitive material. Suitable examples of the precursors of developing agents to be used include indoaniline type compounds as described in U.S. Pat. No. 3,342,597, Schiff's base type compounds as described in U.S. Pat. No. 3,342,599 and *Research Disclosure*, RD No. 14850 (Aug., 1976), and ibid., RD No. 15159 (Nov., 1976), aldol compounds as described in *Research Disclosure*, RD No. 13924 (Nov., 1975), metal salt complexes as described in U.S. Pat. No. 3,719,492, urethane type compounds as described in Japanese Patent Application (OPI) No. 135628/78, and various salt type precursors as described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82, 83565/82, etc.

Further, the color photographic light-sensitive material used in the present invention may contain various 1-phenyl-3-pyrazolidones for the purpose of accelerating color development. Typical examples of the compounds are described in Japanese Patent Application (OPI) Nos. 64339/81, 144547/82, 211147/82, 50532/83, 50536/83, 50533/83, 50534/83, 50535/83, 115438/83, etc.

Moreover, in the case of continuous processing, the variation of composition in each processing solution is prevented by using a replenisher for each processing solution, whereby a constant finish can be achieved. The amount of replenisher can be reduced to one half or less of the standard amount of replenishment for the purpose of reducing cost.

In each of the processing baths, various devices such as a heater, a temperature sensor, a liquid level sensor, a circulation pump, a filter, a floating cover, and a squeegee, etc., may be provided, if desired.

According to the method of the present invention, it is possible to carry out a rapid and stable processing even though the amount of water required for the water washing step or stabilizing step is reduced significantly. Further, since benzyl alcohol is not substantially used in the color developing solution, the load for prevention from environmental pollution is reduced and the work for preparing the processing solution is simplified. Moreover, stability of images after processing is improved. As a result, it becomes possible to produce rapidly and with stability a large amount of color prints, and thus productivity can be extremely raised by utilizing the method of the present invention.

The present invention is described in greater detail with reference to the following examples, but the present invention is not to be construed as being limited thereto.

In the following, methods for preparations of silver halide emulsions employed in Examples 1 to 3 are described.

A silver halide emulsion for a blue-sensitive layer containing 95 mol % of silver chloride was prepared in the following manner.

| | |
|---|---|
| Solution 1 | |
| $H_2O$ | 1,000 ml |
| NaCl | 5.5 g |
| Gelatin | 32 g |
| Solution 2 | |
| Sulfuric acid (1 N) | 20 ml |
| Solution 3 | |
| A silver halide solvent (1%) of the formula: | 3 ml |

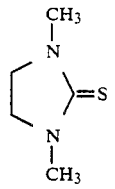

| | |
|---|---|
| Solution 4 | |
| KBr | 0.88 g |
| NaCl | 8.17 g |
| $H_2O$ to make | 130 ml |
| Solution 5 | |
| $AgNO_3$ | 25 g |
| $NH_4NO_3$ (50%) | 0.5 ml |
| $H_2O$ to make | 130 ml |
| Solution 6 | |
| KBr | 3.5 g |
| NaCl | 32.68 g |
| $K_2IrCl_6$ (0.001%) | 0.7 ml |
| $H_2O$ to make | 285 ml |
| Solution 7 | |
| $AgNO_3$ | 100 g |
| $NH_4NO_3$ (50%) | 2 ml |
| $H_2O$ to make | 285 ml |

Solution 1 was heated at 70° C., Solution 2 and Solution 3 were added thereto and then Solution 4 and Solution 5 were added simultaneously over a period of 60 minutes thereto. After 10 minutes, Solution 6 and Solution 7 were added simultaneously over a period of 25 minutes. After 5 minutes, the temperature was dropped to room temperature and the mixture was desalted. Water and gelatin for dispersion were added thereto and pH was adjusted to 6.2 whereby a monodispersed cubic silver chlorobromide emulsion (having an average grain size of 0.82 μm, a coefficient of variation (a value obtained by dividing the standard deviation by an average grain size: s/d) of 0.08 and a silver chloride content of 95 mol %) was obtained. The emulsion was subjected to optimum chemical sensitization using sodium thiosulfate.

A silver halide emulsion for a green-sensitive layer containing 95 mol % of silver chloride was prepared in the following manner.

Solution 8

-continued

| | |
|---|---|
| $H_2O$ | 1,000 ml |
| NaCl | 5.5 g |
| Gelatin | 32 g |
| Solution 9 | |
| Sulfuric acid (1 N) | 24 ml |
| Solution 10 | |
| A silver halide solvent (1%) same as in Solution 3 | 3 ml |
| Solution 11 | |
| KBr | 1.12 g |
| NaCl | 10.46 g |
| $H_2O$ to make | 220 ml |
| Solution 12 | |
| $AgNO_3$ | 32 g |
| $H_2O$ to make | 200 ml |
| Solution 13 | |
| KBr | 4.48 g |
| NaCl | 41.83 g |
| $K_2IrCl_6$ (0.001%) | 4.5 ml |
| $H_2O$ to make | 600 ml |
| Solution 14 | |
| $AgNO_3$ | 128 g |
| $H_2O$ to make | 600 ml |

Solution 8 was heated to 56° C., Solution 9 and Solution 10 were added thereto, and then Solution 11 and Solution 12 were added simultaneously over a period of 10 minutes thereto. After 10 minutes, Solution 13 and Solution 14 were added simultaneously over a period of 8 minutes. After 5 minutes, the temperature was dropped to room temperature and the mixture was desalted. Water and gelatin for dispersion were added thereto and the pH was adjusted to 6.2 whereby a monodispersed cubic silver chlorobromide emulison (having an average grain size of 0.44 μm, a coefficient of variation of 0.09 and a silver chloride content of 95 mol %) was obtained. The emulsion was subjected to optimum chemical sensitization using sodium thiosulfate.

In the same manner as described above except for changing the compositions of Solution 11 and Solution 13 and temperature, a monodispersed cubic silver chlorobromide emulsion (having an average grain size of 0.50 μm, a coefficient of variation of 0.09 and a silver chloride content of 95 mol %) for a red-sensitive layer was obtained. The emulsion was subjected to optimum chemical sensitization using sodium thiosulfate.

In the following, the methods for preparation of the silver halide emulsion employed in Example 4 are described.

A pure silver chloride emulsion for a blue-sensitive layer was prepared in the following manner.

| | |
|---|---|
| Solution 15 | |
| $H_2O$ | 1,000 ml |
| NaCl | 5.5 g |
| Gelatin | 32 g |
| Solution 16 | |
| Sulfuric acid (1 N) | 20 ml |
| Solution 17 | |
| A silver halide solvent (5%) of the formula: $HOCH_2CH_2SCH_2CH_2SCH_2CH_2OH$ | 1.7 ml |
| Solution 18 | |
| NaCl | 8.60 g |
| $H_2O$ to make | 130 ml |
| Solution 19 | |
| $AgNO_3$ | 25 g |
| $NH_4NO_3$ (50%) | 0.5 ml |
| $H_2O$ to make | 130 ml |

-continued

| | |
|---|---|
| Solution 20 | |
| NaCl | 34.4 g |
| $K_2IrCl_6$ (0.001%) | 0.7 ml |
| $H_2O$ to make | 285 ml |
| Solution 21 | |
| $AgNO_3$ | 100 g |
| $NH_4NO_3$ (50%) | 2 ml |
| $H_2O$ to make | 285 ml |

Solution 15 was heated at 72° C., Solution 16 and Solution 17 were added thereto and then Solution 18 and Solution 19 were added simultaneously over a period of 60 minutes thereto. After 10 minutes, Solution 20 and Solution 21 were added simultaneously over a period of 25 minutes. After 5 minutes, the temperature was dropped to room temperature and the mixture was desalted. Water and gelatin for dispersion were added thereto and pH was adjusted to 6.2, whereby a monodispersed cubic pure silver chloride emulsion (having an average grain size of 0.8 μm, a coefficient of variation (a value obtained by dividing the standard deviation by an average grain size: s/d) of 0.1 was obtained. The emulsion was subjected to gold and sulfur sensitizations. Gold was added in an amount of $1.0\times10^{-4}$ mol per mol of Ag and optimum chemical sensitization was conducted using sodium thiosulfate.

A silver halide emulsion for a green-sensitive layer containing 99.5 mol % of silver chloride was prepared in the following manner.

| | |
|---|---|
| Solution 22 | |
| $H_2O$ | 1,000 ml |
| NaCl | 5.5 g |
| Gelatin | 32 g |
| Solution 23 | |
| Sulfuric acid (1 N) | 24 ml |
| Solution 24 | |
| A silver halide solvent (1%) same as in Solution 17 | 3 ml |
| Solution 25 | |
| KBr | 0.11 g |
| NaCl | 10.95 g |
| $H_2O$ to make | 220 ml |
| Solution 26 | |
| $AgNO_3$ | 32 g |
| $H_2O$ to make | 200 ml |
| Solution 27 | |
| KBr | 0.45 g |
| NaCl | 43.81 g |
| $K_2IrCl_6$ (0.001%) | 4.5 ml |
| $H_2O$ to make | 600 ml |
| Solution 28 | |
| $AgNO_3$ | 128 g |
| $H_2O$ to make | 600 ml |

Solution 22 was heated at 40° C., Solution 23 and Solution 24 were added thereto and then Solution 25 and Solution 26 were added simultaneously over a period of 10 minutes thereto. After 10 minutes, Solution 27 and Solution 28 were added simultaneously over a period of 8 minutes. After 5 minutes, the temperature was dropped to room temperature and the mixture was desalted. Water and gelatin for dispersion were added thereto and pH was adjusted to 6.2, whereby a monodispersed cubic silver chlorobromide emulsion (having an average grain size of 0.3 μm, a coefficient of variation of 0.1 and a silver chloride content of 99.5 mol %) was obtained. The emulsion was subjected to gold sensitization using $4.1\times10^{-4}$ mol of chloroauric acid per mol of Ag.

In the same manner as described above except for changing the compositions of Solution 25 and Solution 27 and temperature, a monodispersed cubic silver chlorobromide emulsion (having an average grain size of 0.4 μm, a coefficient of variation of 0.1 and a silver chloride content of 99 mol %) for a red-sensitive layer was obtained. The emulsion was subjected to gold and sulfur sensitizations. Gold was added in an amount of $4.1\times10^{-4}$ mol per mol of Ag and optimum chemical sensitization was conducted using sodium thiosulfate.

EXAMPLE 1

On a paper support, both surfaces of which were laminated with polyethylene, were coated layers as shown in Table 1 below in order to prepare a multilayer color printing paper. The coating solutions were prepared in the following manner.

PREPARATION OF COATING SOLUTION FOR FIRST LAYER 19.1 g of Yellow Coupler (a) and 4.4 g of Color Image Stabilizer (b) were dissolved in a mixture of 27.2 ml of ethyl acetate and 7.9 ml of Solvent (c) and the resulting solution was emulsified and dispersed in 185 ml of a 10% aqueous solution of gelatin containing 8 ml of a 10% aqueous solution of sodium dodecylbenzenesulfonate. Separately, to a silver chlorobromide emulsion (having a silver chloride content of 95 mol % and containing 70 g of silver per kg of the emulsion) was added $7.0\times10^{-4}$ mol of a blue-sensitive sensitizing dye shown below per mol of the silver chlorobromide to prepare a blue-sensitive emulsion. The above-described dispersion was mixed with 90 g of the blue-sensitive silver chlorobromide emulsion, with the concentration of the resulting mixture being controlled with gelatin, to form the composition shown in Table 1 below, i.e., the coating solution for the first layer.

Coating solutions for the second layer to the seventh layer were prepared in a similar manner as described for the coating solution for the first layer. 1-Oxy-3,5-dichloro-s-triazine sodium salt was used as a gelatin hardener in each layer.

The following spectral sensitizing dyes were employed in the indicated emulsion layers, respectively.

Blue-Sensitive Emulsion Layer:

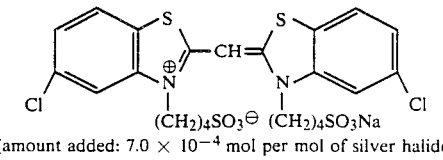

(amount added: $7.0\times10^{-4}$ mol per mol of silver halide)

Green-Sensitive Emulsion Layer:

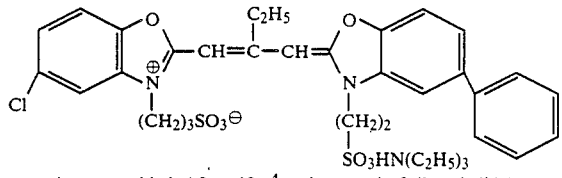

(amount added: $4.0\times10^{-4}$ mol per mol of silver halide)

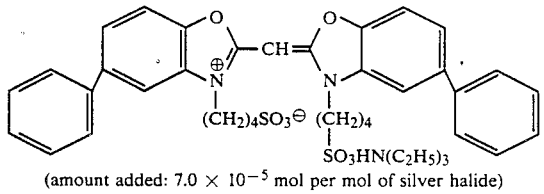

(amount added: $7.0\times10^{-5}$ mol per mol of silver halide)

Red-Sensitive Emulsion Layer:

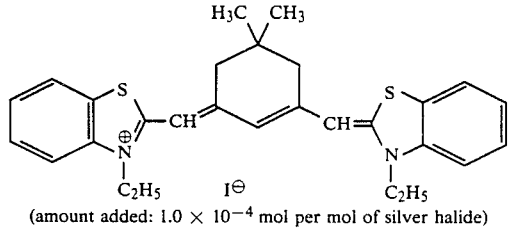

(amount added: $1.0\times10^{-4}$ mol per mol of silver halide)

The following dyes were employed as irradiation preventing dyes in the indicated emulsion layers, respectively.

Green-Sensitive Emulsion Layer:

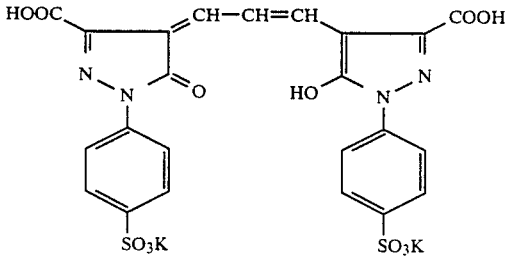

Red-Sensitive Emulsion Layer:

-continued

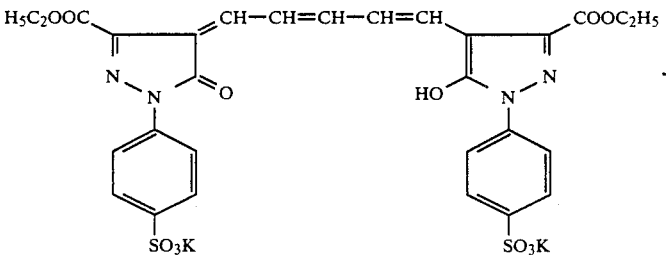

TABLE 1

| | |
|---|---|
| Seventh Layer: Protective Layer | |
| Gelatin | 1.33 g/m$^2$ |
| Acryl-modified polyvinyl alcohol copolymer (degree of modification: 17%) | 0.17 g/m$^2$ |
| Sixth Layer: Ultraviolet Light Absorbing Layer | |
| Gelatin | 0.54 g/m$^2$ |
| Ultraviolet Light Absorbing Agent (h) | 0.21 g/m$^2$ |
| Solvent (j) | 0.09 ml/m$^2$ |
| Fifth Layer: Red-Sensitive Layer | |
| Silver chlorobromide emulsion (silver chloride: 95 mol %) | 0.26 g/m$^2$ (as silver) |
| Gelatin | 0.98 g/m$^2$ |
| Cyan Coupler (k) | 0.38 g/m$^2$ |
| Color Image Stabilizer (l) | 0.17 g/m$^2$ |
| Solvent (m) | 0.23 ml/m$^2$ |
| Fourth Layer: Ultraviolet Light Absorbing Layer | |
| Gelatin | 1.60 g/m$^2$ |
| Ultraviolet Light Absorbing Agent (h) | 0.62 g/m$^2$ |
| Color Mixing Preventing Agent (i) | 0.05 g/m$^2$ |
| Solvent (j) | 0.26 ml/m$^2$ |
| Third Layer: Green Sensitive Layer | |
| Silver chlorobromide emulsion (silver chloride: 95 mol %) | 0.16 g/m$^2$ (as silver) |
| Gelatin | 1.80 g/m$^2$ |
| Magenta Coupler (e) | 0.34 g/m$^2$ |
| Color Image Stabilizer (f) | 0.20 g/m$^2$ |
| Solvent (g) | 0.68 ml/m$^2$ |
| Second Layer: Color Mixing Preventing Layer | |
| Gelatin | 0.99 g/m$^2$ |
| Color Mixing Preventing Agent (d) | 0.08 g/m$^2$ |
| First Layer: Blue-Sensitive Layer | |
| Silver chlorobromide emulsion (silver chloride: 95 mol %) | 0.30 g/m$^2$ (as silver) |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.34 ml/m$^2$ |

SUPPORT

Polyethylene laminated paper (the polyethylene coating sontaining a white pigment ($TiO_2$, etc.) and a bluish dye (ultramarine, etc.) on the first layer side)

The compounds used in the above-described layers have the structures shown below, respectively.

Yellow Coupler (a)

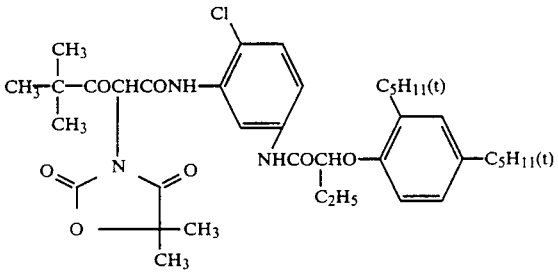

-continued

Color Image Stabilizer (b)

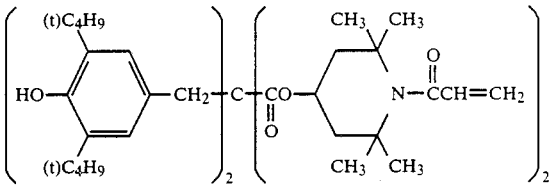

Solvent (c)

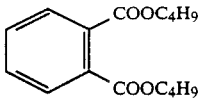

Color Mixing Preventing Agent (d)

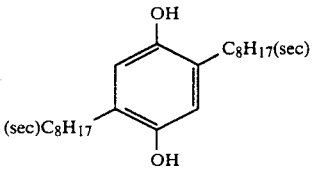

Magenta Coupler (e)

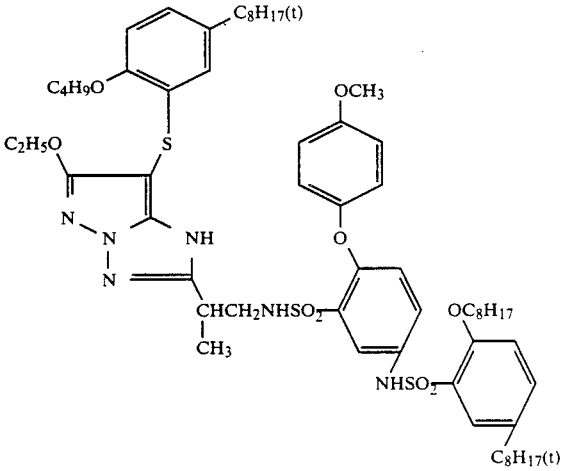

Color Image Stabilizer (f)

-continued

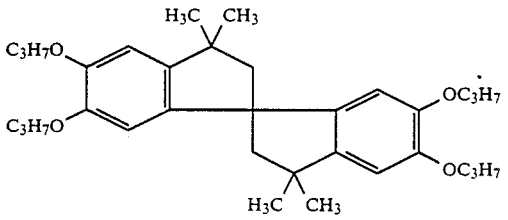

Solvent (g)

A mixture of $(C_8H_{17}O)_3P{=}O$ and

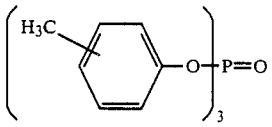

in a weight ratio of 2/1.

Ultraviolet Light Absorbing Agent (h)

A mixture of

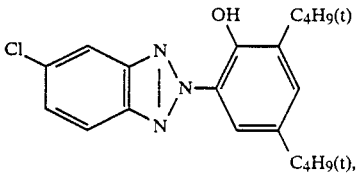

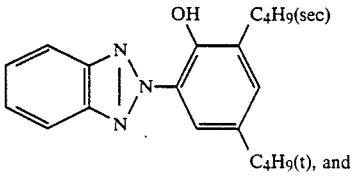

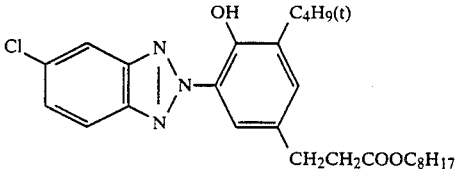

in a molar ratio of 1/5/3.

Color Mixing Preventing Agent (i)

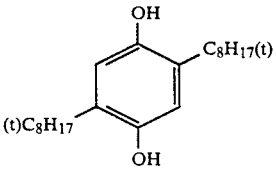

Solvent (j)

$(iso\text{-}C_9H_{19}O)_3P{=}O$

Cyan Coupler (k)

A mixture of

-continued

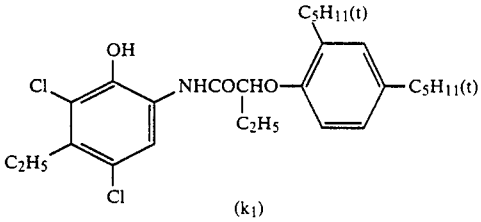

$(k_1)$ and

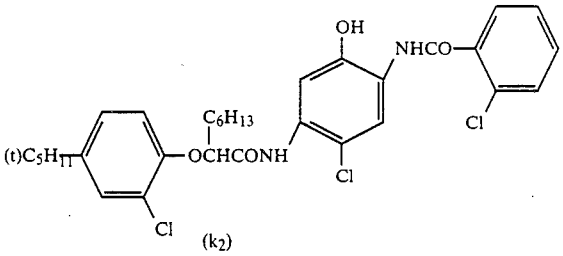

$(k_2)$ in a molar ratio of 1/1.

Color Image Stabilizer (l)

A mixture of

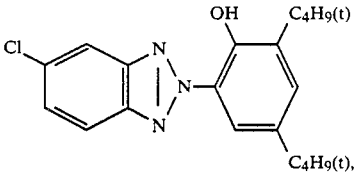

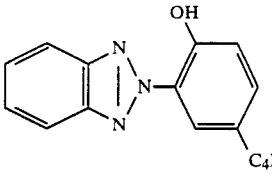

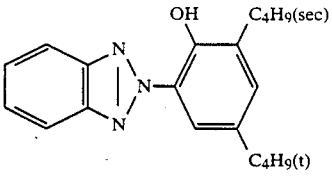

in a molar ratio of 1/3/3.

Solvent (m)

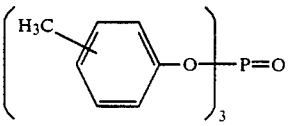

The multilayer color printing paper thus prepared was imagewise exposed to light and subjected to continuous processing according to the processing steps as shown below using a Fuji Color Roll Processor FPRP 115 (manufactured by Fuji Photo Film Co., Ltd.). With processor, the processing time of the water washing step is changeable.

| Processing Step | Time | Temperature (°C.) | Capacity of Tank (l) |
|---|---|---|---|
| Color Development | 1 min 40 sec | 38 ± 0.3 | 60 |
| Bleach-Fixing | 1 min 30 sec | 33 ± 1 | 40 |
| Washing with Water (1) | 1 min 00 sec | 30 ± 3 | 20 |
| Washing with Water (2) | 1 min 00 sec | 30 ± 3 | 20 |
| Washing with Water (3) | 1 min 00 sec | 30 ± 3 | 20 |

The water washing steps were carried out by a three-stage countercurrent water washing process from washing with water (3) to washing with water (1).

Further, the amount of processing solution carried in the tank from the preceding tank was 40 ml per $m^2$ of the color photographic light-sensitive material processed in each step of from the bleach-fixing step to the washing with water step (3).

The amount of replenisher in the color development step was 161 ml per $m^2$ of the color photographic light-sensitive material processed. The composition of the color developing solution used was as follows.

| Color Developing Solution | Tank Solution | Replenisher |
|---|---|---|
| Water | 800 ml | 800 ml |
| Chelating agent | Shown in Table 2 below | |
| Benzyl alcohol | Shown in Table 2 below | |
| Diethylene glycol | 10 ml | 10 ml |
| Sodium sulfite | 2.0 g | 2.5 g |
| Hydroxylamine sulfate | 3.0 g | 3.5 g |
| Potassium bromide | 0.3 g | — |
| Sodium carbonate | 30 g | 35 g |
| N-Ethyl-N-(β-methanesulfonamido-ethyl)-3-methyl-4-aminoaniline sulfate | 5.0 g | 8.0 g |
| Water to make | 1,000 ml | 1,000 ml |
| pH | 10.15 | 10.65 |

The amount of replenisher in the bleach-fixing step was 60 ml per $m^2$ of the color photographic light-sensitive material processed. The composition of the bleach-fixing solution used was as follows.

| Bleach-Fixing Solution | Tank Solution | Replenisher |
|---|---|---|
| Water | 400 ml | 400 ml |
| Ammonium thiosulfate (70% soln.) | 150 ml | 300 ml |
| Sodium sulfate | 18 g | 36 g |
| Ammonium ethylenediaminetetra-acetate iron (III) | 55 g | 110 g |
| Disodium ethylenediaminetetra-acetate | 5 g | 10 g |
| Water to make | 1,000 ml | 1,000 ml |
| pH | 6.70 | 6.50 |

The amount of replenishing water in the water washing step was 250 ml per $m^2$ of the color photographic light-sensitive material processed.

Under the above-described conditions, the color photographic light-sensitive material described above having a width of 8.25 cm was processed at 180 m per day for 60 days.

In Table 2 below, the chelating agent employed and the amount added thereof (per liter of the color developing solution) and the amount of benzyl alcohol added (per liter of the color developing solution) are set forth.

TABLE 2

| | Processing (1) (Comparison) | | Processing (2) (Present Invention) | | Processing (3) (Present Invention) | |
|---|---|---|---|---|---|---|
| | Tank Solution | Replenisher | Tank Solution | Replenisher | Tank Solution | Replenisher |
| Chelating Agent | A | A | A | A | A + B | A + B |
| Amount of Chelating Agent (per liter) | 2.0 g | 2.0 g | 2.0 g | 2.0 g | A: 2.0 g<br>B: 3.3 g | A: 2.0 g<br>B: 3.3 g |
| Amount of Benzyl Alcohol (per liter) | 14.0 ml | 18.0 ml | 0 ml | 0 ml | 0 ml | 0 ml |

Chelating Agent A: Trisodium nitrilotriacetate
Chelating Agent B: 1-Hydroxyethylidene-1,1-diphosphonic acid (60% (w/w) aqueous solution)

The number of days until the floating scum, precipitates, muddiness, and coloration occurred in water washing tank (2) is shown in Table 3 below. In Table 3, the mark "○" means that neither floating scum, precipitates, nor muddiness occurred and the color of water hardly changed in comparison with the fresh water in processing for 60 days.

TABLE 3

| | Processing (1) (Comparison) | Processing (2) (Present Invention) | Processing (3) (Present Invention) |
|---|---|---|---|
| Floating Scum in Water Washing Tank (2) | 12 | o | o |
| Precipitate and Muddiness in Water Washing Tank (2) | 10 | o | o |
| Coloration in Water Washing Tank (2) | Blackish Brown | Light Brown | o |

It is apparent from the results shown in Table 3 that the floating scum, precipitates, muddiness, and coloration occurred in water washing tank (2) in a short period of time such as about 10 days with Processing (1) for comparison. On the contrary, the floating scum did not uccur with Processings (2) and (3), according to the present invention, and precipitates and muddiness only occurred at the final stage of Processing (2). Further, the change in color was hardly observed. It is surprising that the liquid stability in the water washing process with a small amount of replenishment is improved by means of eliminating benzyl alcohol from the color developing solution as described above.

EXAMPLE 2

A multilayer color printing paper was prepared in the same manner as described in Example 1 except for using Magenta Coupler (A) shown below in place of Magenta Coupler (e). The processing was carried out for 60 days in a manner similar to Example 1. The chelating agent employed and the amount added thereto and the amount of benzyl alcohol added are shown in Table 4 below. In the example, a rinse solution having the composition shown below was used in place of water for washing. The amount of replenishment was 250 ml/m$^2$, the same as in Example 1.

| Rinse Solution | Tank Solution | Replenisher |
|---|---|---|
| Water | 900 ml | 900 ml |
| Ethylenediamine-N,N,N',N'-tetramethylenephosphoric acid | $5 \times 10^{-3}$ mol | $5 \times 10^{-3}$ mol |
| Water to make | 1,000 ml | 1,000 ml |
| pH | 7.0 | 7.0 |

TABLE 4

| Magenta Coupler Amount Used | Processing (4) (Comparison) (A) 0.35 g/m$^2$ | | Processing (5) (Present Invention) (A) 0.35 g/m$^2$ | | Processing (6) (Present Invention) (e) 0.34 g/m$^2$ | |
|---|---|---|---|---|---|---|
| | Tank Solution | Replenisher | Tank Solution | Replenisher | Tank Solution | Replenisher |
| Chelating Agent | A + B | A + B | A + B | A + B | A + B | A + B |
| Amount of Chelating Agent (per liter) | A: 2.0 g B: 3.0 g | A: 2.0 g B: 3.0 g | A: 2.0 g B: 3.0 g | A: 2.0 g B: 3.0 g | A: 2.0 g B: 3.0 g | A: 2.0 g B: 3.0 g |
| Amount of Benzyl Alcohol (per liter) | 14 ml | 18 ml | 0 ml | 0 ml | 0 ml | 0 ml |

Magenta Coupler (A)

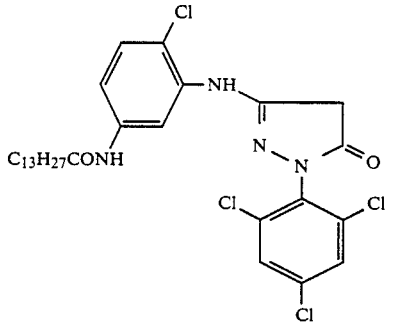

The number of days until floating scum, precipitates, and muddiness occurred in water washing tank (2) is shown in Table 5 below, in the same manner as in Example 1.

TABLE 5

| | Processing (4) (Comparison) | Processing (5) (Present Invention) | Processing (6) (Present Invention) |
|---|---|---|---|
| Floating Scum in Water Washing Tank (2) | 14 | o | o |
| Precipitate and Muddiness in Water Washing Tank (2) | 12 | o | o |

Further, after processing for 90 days, the multilayer color printing papers employed in Processings (4) to (6) respectively were wedgewise exposed and processed according to corresponding Processings (4) to (6), respectively. The samples thus obtained were stored under the conditions of 80° C. and 70% RH (relative humidity) for 5 weeks. The magenta density of each sample was measured at the area having the initial density of 2.0 and the rate of decrease in magenta dye density after the preservation was determined. The results thus obtained are shown in Table 6 below.

TABLE 6

| | Processing (4) (Comparison) | Processing (5) (Present Invention) | Processing (6) (Present Invention) |
|---|---|---|---|
| Rate of Decrease in Magenta Dye Density (%) | 15 | 8 | 5 |

It is apparent from the results shown in Table 5 that the liquid stability of the rinse solution is improved according to the method of the present invention, the same as in Example 1. Further, as is apparent from the results shown in Table 6, the color fading of magenta dyes in the photographic light-sensitive material of a high silver chloride content under the conditions of 80° C. and 70% RH is restrained according to the method of the present invention. Particularly, in the processing using the pyrazolotriazole type magenta coupler as Processing (6), the color fading of magenta dyes is restrained and thus color photographic images having good preservability can be obtained.

EXAMPLE 3

Sample B was prepared in the same manner as described for the sample prepared in Example 1 except that the blue-sensitive layer was arranged at the farthest position from the support by replacing the red-sensitive layer with the blue-sensitive layer. The sample prepared in Example 1 was designated Sample A.

Samples A and B were exposed stepwise so as to obtain gray color, and then subjected to color development processing using the solutions of Processings (4) and (5) after the processing for 90 days as in Example 2. The samples thus obtained were allowed to stand in a place where the sun shines through a window glass during the day for 120 days, and the fading rates of cyan, magenta and yellow were determined, respectively. The results thus obtained are shown in Table 7 below. The fading rate is indicated as the degree (%) of decrease in density at the area having the initial density of 2.0. The larger value means the larger fading.

TABLE 7

| Sample | Processing | Layer* | Fading Rate (%) |
|---|---|---|---|
| A (the blue-sensitive layer is the undermost layer) | (4) (Comparison) | C | 27.0 |
| | | M | 25.0 |
| | | Y | 5.0 |
| A (the blue-sensitive layer is the undermost layer) | (5) (Invention) | C | 27.5 |
| | | M | 22.0 |
| | | Y | 5.0 |
| B (the red-sensitive layer is the undermost layer) | (4) (Comparison) | C | 22.0 |
| | | M | 25.0 |
| | | Y | 11.0 |
| B (the red-sensitive layer is the undermost layer) | (5) (Invention) | C | 22.0 |
| | | M | 22.0 |
| | | Y | 10.4 |

*C, M and Y indicate the cyan, magenta and yellow components of the samples formed gray color, respectively.

As is apparent from the results shown in Table 7, the sample having the red-sensitive layer as the undermost layer is preferred since the balance of fading due to light in three layers is good and the deviation from gray is small when observed visually. Further, Processing (5) shows somewhat better light fastness than Processing (4).

EXAMPLE 4

A multilayer color printing paper was prepared in the same manner as described in Example 1 except that the silver halide emulsions, spectral sensitizing dyes and couplers to be used, etc., were changed as indicated below.

In the preparation of the coating solution for the first layer, the silver halide emulsion was changed to a pure silver chloride emulsion (containing 70 g of silver per kg of the emulsion), the spectral sensitizing dye was changed to a monomethine cyanine dye shown below, the amount of the spectral sensitizing dye was changed to $9.0\times10^{-4}$ mol per mol of silver chloride, immediately after the addition of the spectral sensitizing dye, an aqueous solution of potassium bromide was added in an amount corresponding to 0.5 mol per mol of silver chloride as bromine ions whereby the spectral sensitizing dye was adsorbed on silver chloride and a mercapto compound shown below was added in an amount of $1\times10^{-3}$ mol per mol of silver chloride. Thus, 90 g of a blue-sensitive emulsion was prepared.

Spectral Sensitizing Dye

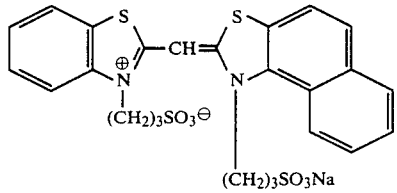

Mercapto Compound

-continued

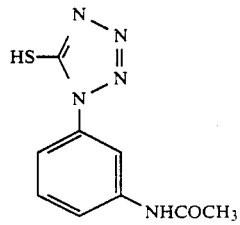

The silver chloride emulsion used was a monodispersed emulsion having an average grain diameter of about 0.8 μm and a rate of variation of about 10%.

Other factors were the same as in Example 1.

Further, in the preparation of the coating solution for the third layer, the silver halide emulsion was changed to a silver chloride emulsion (having a silver chloride content of 99.5 mol %, a silver bromide content of 0.5 mol %, an average grain diameter of 0.3 μm and a rate of variation of about 10%) and as a magenta coupler, a 3-anilino-5-pyrazolone type coupler shown below was used in an equimolar amount of the magenta coupler employed in Example 1.

Magenta Coupler

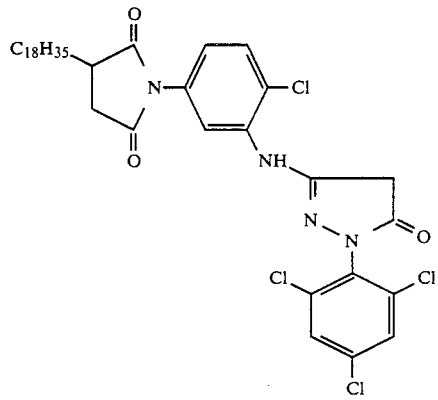

Immediately after the addition of the spectral sensitizing dye employed in the green-sensitive emulsion layer as described in Example 1, an aqueous solution of potassium bromide was added in an amount corresponding to 0.3 mol per mol of silver chloride as bromine ions, whereby a sensitizing function of the spectral sensitizing dye is stabilized. Further, the mercapto compound described above was added in an amount of $1.1\times10^{-3}$ mol per mol of silver chloride. Other factors were the same as in Example 1.

Moreover, in the preparation of the coating solution for the fifth layer, the silver halide emulsion was changed to a monodispersed silver chlorobromide emulsion (having a silver chloride content of 99 mol %, a silver bromide content of 1 mol %, an average grain diameter of about 0.4 μm and a rate of variation of about 10%). Further, the mercapto compound described above was added in an amount of $1\times10^{-3}$ mol per mol of silver chlorobromide, whereby the silver chlorobromide emulsion was stabilized and antifogged (rendered fog resistant). Other factors were the same as in Example 1.

The multilayer color printing paper thus prepared was imagewise exposed and subjected to Processing (2) according to the present invention as shown in Example 1. The gradation used for the image exposure was well reproduced. Further, the sample processed was subjected to a fading test under the forced conditions of 80° C. and 75% RH for 5 weeks. As a result, the degradation of images was not so conspicuous, since the fadings of R, G and B was comparatively balanced.

Further, the same result was obtained when the magenta coupler was changed to the following magenta coupler.

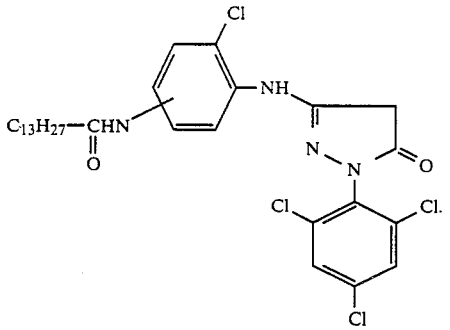

Furthermore, the same stabilizing and anti-fogging effects were obtained in the case of using a compound having a methylureido group in place of the acetylamido group of the above-described mercapto compound.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material for a print comprising:

color developing a silver halide color photographic material comprising a reflective support having thereon at least one silver halide emulsion layer containing a silver halide having a silver chloride content of not less than 90 mol % silver chloride and containing 2 mol % or less silver iodide using a color developing solution containing less than 0.5 ml of benzyl alcohol per liter of said color developing solution, then bleach-fixing said color photographic material, followed by either stabilizing with a stabilizing solution or water washing said color photographic material, where the amount of replenisher for said stabilizing solution or said washing water used in the stabilizing or water washing is from 30 to 50 times the amount of processing solution carried over from a preceding bath per unit area of the color photographic material.

2. A method for processing a silver halide color photographic material for a print comprising:

color developing a silver halide color photographic material comprising a reflective support having thereon at least one silver halide emulsion layer containing a silver halide having a silver chloride content of not less than 90 mol % silver chloride and containing 2 mol % or less silver iodide using a color developing solution containing less than 0.5 ml of benzyl alcohol per liter containing of said color developing solution and an organic phosphonic chelating agent, then bleach-fixing said color photographic material, followed by either stabilizing with a stabilizing solution or water washing said color photographic material, where the amount of replenisher for said stabilizing solution or said washing water used in the stabilizing or water washing is from 30 to 50 times the amount of processing solution carried over from a preceding bath per unit area of the color photographic material.

3. A method for processing a silver halide color photographic material for a print comprising:

color developing a silver halide color photographic material comprising a reflective support having thereon at least one silver halide emulsion layer containing a silver halide having a silver chloride content of not less than 90 mol % silver chloride and containing 2 mol % or less silver iodide and containing a pyrazoloazole magenta coupler represented by formula (I)

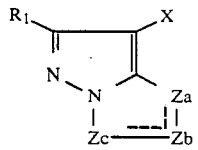

(I)

wherein $R_1$ represents a hydrogen atom or a substituent;

X represents a hydrogen atom or a group capable of being released upon a coupling reaction with an oxidation product of an aromatic primary amine developing agent;

Za, Zb and Zc each represents a methine group, a substituted methine group, =N—, or —NH—, with one of the Za-Zb bond and the Zb-Zc bond being a double bond and the other being a single bond; when the Zb-Zc bond is a carbon-carbon double bond, the Zb-Zc bond may be apart of a condensed aromatic ring; or $R_1$ or X forms a dimer or higher polymer; or Za, Zb, or Zc is a substituted methine group forming a dimer or higher polymer using a color developing solution containing less than 0.5 ml of benzyl alcohol per liter of said color developing solution, then bleach-fixing said color photographic material, followed by either stabilizing with a stabilizing solution or water washing said color photographic material, where the amount of replenisher for said stabilizing solution or said washing water used in the stabilizing or water washing is from 30 to 50 times the amount of processing solution carried over from a preceding bath per unit area of the color photographic material.

4. A method for processing a silver halide color photographic material as claimed in claim 1, wherein said silver halide emulsion has a deviation coefficient of not more than 20%.

5. A method for processing a silver halide color photographic material as in claim 1, wherein the color developing solution does not contain benzyl alcohol.

6. A method for processing a silver halide color photographic material as in claim 1, 2 or 3, wherein the silver halide emulsion does not contain silver iodide.

7. A method for processing a silver halide color photographic material as in claim 3, wherein the magenta coupler is a bis coupler or a polymeric coupler containing a coupler moiety represented by formula (I).

8. A method for processing a silver halide color photographic material as in claim 7, wherein the magenta coupler is a homopolymer composed of a monomer having a coupler moiety represented by formula (I) or a copolymer composed of a monomer having a coupler moiety represented by formula (I) and a non-color-forming ethylenic monomer which does not undergo coupling with the oxidation product of an aromatic primary amine developing agent.

9. A method for processing a silver halide color photographic material as in claim 3, wherein the magenta coupler is selected from those represented by formulae (II), (III), (IV), (V), (VI) and (VII)

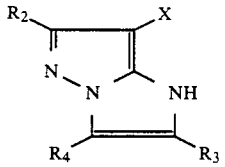
(II)

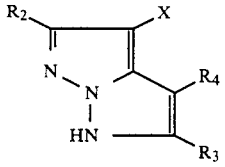
(III)

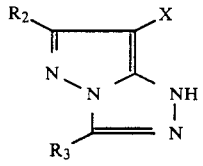
(IV)

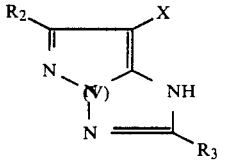
(V)

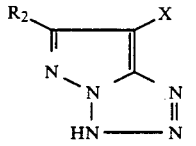
(VI)

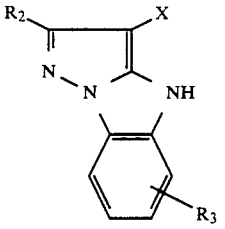
(VII)

wherein $R_2$, $R_3$ and $R_4$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; and X represents a hydrogen atom, a halogen atom, a carboxy group or a group capable of being released upon coupling which is bonded to the carbon atom at the coupling position through an oxygen atom, a nitrogen atom, or a sulfur atom; or $R_2$, $R_3$, $R_4$ or X is a divalent group forming a bis coupler.

10. A method for processing a silver halide color photographic material as in claim 9, wherein the magenta coupler is represented by formula (IV) or (V).

11. A method for processing a silver halide color photographic material as in claim 10, wherein the magenta coupler is represented by formula (IV) or (V) wherein at least one of $R_2$ and $R_3$ is a branched substituted or unsubstituted alkyl group that is an alkyl group or a substituted alkyl group which is connected to a pyrazoloazole skeleton through a secondary or tertiary carbon atom.

12. A method for processing a silver halide color photographic material as in claim 11, wherein the secondary or tertiary carbon atom has at least two groups selected from the group consisting of an alkyl group and a substituted alkyl group.

13. A method for processing a silver halide color photographic material as in claim 12, wherein the secondary or tertiary carbon atom has at least one group selected from the group consisting of a sulfonamidoalkyl group, a sulfonamidoarylalkyl group, and a sulfonylalkyl group.

14. A method for processing a silver halide color photographic material as in claim 1, 2 or 3, wherein the silver halide has a silver chloride content of not less than 95 mol %.

15. A method for processing a silver halide color photographic material as in claim 1, 2 or 3, wherein the silver halide predominantly forms a latent image on the surface thereof upon exposure to light.

16. A method for processing a silver halide color photographic material as in claim 1, 2 or 3, wherein the silver halide emulsion contains silver halide grains having a cubic or tetradecahedral crystal form.

17. A method for processing a silver halide color photographic material as in claim 2, wherein the organic phosphonic acid type chelating agent is selected from the group consisting of 1-hydroxyethylidene-1,1-diphosphonic acid, nitroso-N,N,N-trimethylenephosphonic acid, and ethylenediamine-N,N,N',N'-tetramethylenephosphonic acid.

18. A method for processing a silver halide color photographic material as in claim 2, wherein the amount of the organic phosphonic acid type chelating agent is from $1\times10^{-5}$ to $1\times10^{-1}$ mol per liter of the color developing solution.

19. A method for processing a silver halide color photographic material as in claim 1, 2 or 3, wherein the silver halide color photographic material further contains a color mixing preventing agent.

20. A method for processing a silver halide color photographic material as in claim 1, 2 or 3, wherein the silver halide color photographic material further contains a color image stabilizer.

21. A method for processing a silver halide color photographic material as in claim 4, 2 or 3, wherein the silver halide color photographic material further contains an ultraviolet light absorbing agent.

22. A method for processing a silver halide color photographic material as in claim 4, 2 or 3, wherein the color developing solution is an alkaline aqueous solution containing an aromatic primary amine color developing agent.

23. A method for processing a silver halide color photographic material as in claim 22, wherein the aromatic primary amine color developing agent is selected from the group consisting of 3-methyl-4-amino-N-ethyl-N-β-hydroxyethylaniline and 3-methyl-4-amino-N-ethyl-N-β-methanesulfonamidoethylaniline.

24. A method for processing a silver halide color photographic material as in claim 23, wherein the aromatic primary amine color developing agent is 3-methyl-4-amino-N-ethyl-N-β-methanesulfonamidoethylaniline.

25. A method for processing a silver halide color photographic material as in claim 4, 2 or 3, wherein a bleach-fixing solution for the bleach-fixing contains a bleaching agent and a fixing agent.

26. A method for processing a silver halide color photographic material as in claim 25, wherein the bleaching agent is an organic complex salt of iron (III).

27. A method for processing a silver halide color photographic material as in claim 25, wherein the fixing agent is a water-soluble silver halide solvent.

28. A method for processing a silver halide color photographic material as in claim 4, 2 or 3, wherein the stabilizing is carried out by a multistage counter-current stabilizing process.

29. A method for processing a silver halide color photographic material as in claim 4, 2 or 3, wherein the water washing is carried out by a multistage counter-current water washing process.

30. A method for processing a silver halide color photographic material as in claim 1, wherein the color developing is conducted for a period of time of from 30 seconds to 1 minute and 40 seconds.

31. A method for processing a silver halide color photographic material as in claim 1, 2 or 3, wherein a concentration of $Br^-$ ions, calculated in terms of KBr, in the color developing solution is from 1.2 g to 0.05 g per liter of the color developing solution.

32. A method for processing a silver halide color photographic material as in claim 1, 2 or 3, wherein the silver halide emulsion contains a 1-phenyl-S-mercaptotetrazole.

* * * * *

UNITED STATES PATENT AND TRADEMARK OFFICE

CERTIFICATE OF CORRECTION

PATENT NO. : 5,001,041

DATED : March 19, 1991

INVENTOR(S) : Shinzo Kishimoto, Shinji Ueda, Kiyoshi Nakazyo

It is certified that error appears in the above-identified patent and that said Letters Patent is hereby corrected as shown below:

Column 79, line 52, delete "30" and insert --3--.

Column 80, line 5, delete "30" and insert --3--.

Column 80, line 52, delete "30" and insert --3--.

Signed and Sealed this

Thirteenth Day of October, 1992

*Attest:*

DOUGLAS B. COMER

*Attesting Officer*

*Acting Commissioner of Patents and Trademarks*